US008296114B2

(12) United States Patent
Prasad et al.

(10) Patent No.: US 8,296,114 B2
(45) Date of Patent: Oct. 23, 2012

(54) SYSTEM, PROGRAM PRODUCT, AND RELATED METHODS FOR BIT DESIGN OPTIMIZATION AND SELECTION

(75) Inventors: Umesh Prasad, Spring, TX (US); Mark W. Dykstra, Kingwood, TX (US); Paul E. Pastusek, The Woodlands, TX (US); Michael L. Doster, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 509 days.

(21) Appl. No.: 12/502,754

(22) Filed: Jul. 14, 2009

(65) Prior Publication Data

US 2010/0030527 A1 Feb. 4, 2010

Related U.S. Application Data

(60) Provisional application No. 61/080,594, filed on Jul. 14, 2008.

(51) Int. Cl.
*G06G 7/48* (2006.01)

(52) U.S. Cl. ..... 703/10

(58) Field of Classification Search ..... 703/10
See application file for complete search history.

(56) References Cited

U.S. PATENT DOCUMENTS

| | | | |
|---|---|---|---|
| 5,787,022 | A | 7/1998 | Tibbitts |
| 6,349,595 | B1 | 2/2002 | Civolani et al. |
| 6,386,297 | B1 | 5/2002 | Cooley |
| 6,424,919 | B1 | 7/2002 | Moran et al. |

OTHER PUBLICATIONS

Arefi et al.; Analysis and simulation of erosion in drilling tools; Wear 259 (2005) 263-270.*
Lucia: Petrophysical Parameters Estimated From Visual Decription of Carbonate Rock: A Field Classification of Carbonate Pore Space; pp. 629-637; SPE; Mar. 1983.*
Petrology of Sedimentary Rocks, Robert L. Folk, Hemphill Publishing Company, Austin, Texas, Apr. 1, 2002, pp. 1-184.
Empirical relations between rock strength and physical properties in sedimentary rocks, Chandong Chang, Mark D. Zoback, Abbas Khaskar, J. of Petroleum Science and Engineering, vol. 51, pp. 223-237, 2006.
The Rock Physics Handbook, Gary Mavko, Tapan Mukerji, and Jack Dvorkin, Cambridge University Press, pp. 307-309, 1998.
Microcracking and Grain Size Effect in Yuen Long Marbles. Wong, H.C. R., Chau K.T. and Wang, P., International J. of Rock mechanics and Mining Sciences pp. 479-485, 1996.

(Continued)

*Primary Examiner* — Hugh Jones
(74) *Attorney, Agent, or Firm* — Cantor Colburn LLP

(57) ABSTRACT

Systems, program product, and methods are provided which include analyzing the drillability of a subterranean formation and a database of performance characteristics for drilling bits to facilitate bit design optimization and selection for that formation. Using component subterranean formation data, computer models can be generated for the drillability of a target section in terms of physical, mechanical, and micro-structural properties, and for postulated suitable drilling bit performance characteristics based on physical, mechanical, and micro-structural properties of the target section. The drilling bit performance characteristics are then updated by quantifying effects of the drilling system to be employed. Each performance characteristic can be normalized and plotted on its own axis for easy comparison. Next, a candidate drilling bit design is selected from a library of computer models of drilling bit characteristics for a suite of drilling bit designs. An optimization of the drilling bit design may be also performed.

12 Claims, 26 Drawing Sheets

OTHER PUBLICATIONS

Rock Fractures and Fluid Flow: Contemporary Understanding and Applications, Commission on Geosciences, Environment and Resources, The National Academic Press Ch 3, 1996, 14 pages (including 103-115).

J.M, Hanson, et al, "Dynamics Modeling of PDC Bits," SPE/IADC 29401, 1995 SPE/IADC Drilling Conference, Amsterdam held Feb. 28-Mar. 2, 1995, pp. 589-604.

P. Choquette, et al., "Geologic Nomenclature and Classification of Porosity in Sedimentary Carbonates," The American Association of Petroleum Geologists Bulletin, V. 54, No. 2 (Feb. 1970), Abstract, p. 207.

Outcrop and Subsurface Characterization of Carbonate Reservoirs for Recovery of Remaining Hydrocarbons, The University of Texas at Austin, Bureau of Economic Geology, 2008, found at www.beg.utexas.edu/indassoc/rcrl/basics/goals_current.htm, pp. 1-8.

Lithologies of the Trenton Group, "Understanding Carbonate Sedimentology," found at www.mcz.harvard.edu/Departments/InvertPaleo/Trenton/Intro/GeologyPage/Sediment..., 2004, pp. 1-18.

M. Abkar et al., A Snapshot of Carbonate Reservoir Evaluation, Oilfield Review, Winter 2000/2001, pp. 20-41.

A. Embry et al., "A Late Devonian Reef Tract on Northeastern Banks Island, N.W.T.", Bulletin of Canadian Petroleum Geology, vol. 19, No. 4 (Dec. 1971), p. 730-781.

* cited by examiner

SYSTEM, PROGRAM PRODUCT, AND RELATED METHODS FOR BIT DESIGN OPTIMIZATION AND SELECTION

RELATED APPLICATIONS

This application is a non-provisional of and claims priority to and the benefit of U.S. Provisional Patent Application No. 61/080,594, filed Jul. 14, 2008, and is related to PCT Patent Application No. PCT/US09/50479, filed Jul. 14, 2009, each incorporated herein by reference in its entirety.

BACKGROUND OF THE INVENTION

1. Field of Invention

This invention relates in general to drilling bit design optimization and selection for use by the oil and gas industry, and in particular to systems, program product, and related methods for selecting and designing a drilling bit tailored for a target section of the earth.

2. Description of the Related Art

Drilling is essential in civil, mining, and petroleum industries. It is also a pre-requisite in exploration and exploitation of oil, gas, and other energy resources. With the depletion of shallow energy resources, however, the cost of drilling is getting increasingly higher; especially, when harder rock formations are encountered and where higher rate of penetration is desired. Therefore, in order to minimize the cost of drilling, it is important that the conditions for optimum performance of drilling are identified.

The optimum performance of drilling depends on large number of factors; most importantly rock type, bit type, rock-bit interactions, hydraulics, stability, and the type of drilling system employed. Over the years, a significant advancement has taken place in understanding of these subjects.

Knowledge of rock and rock-bit interations, however, remains a weak link in drilling. The poor understanding of rock and its interaction with drilling bits primarily stems from the fact that it is an interdisciplinary subject. It requires at least some expertise in the field of geology of rock formations, chemistry of minerals and its bond structures, physics of force or energy application, rock mechanics aspects of the deformation process, and fracture mechanics aspects of the failure process. Moreover, it is difficult, if not sometimes impossible, to mimic the actual drilling process in rocks taking place in the original environments of boreholes. Thus, recognized by the inventors is the need for additional work on rock and its interactions with the drill bit to further enhance the understanding of optimum performance of the bit and drilling system.

In any drilling or cutting process, energy is applied through the cutting tool to generate stresses in the working surface. The stresses may be classified as compressive, shear or tensile or some combination of these. If the stresses are sufficiently high, some type of cutting action occurs, such as crushing, scraping, chipping or indenting. In the drilling industry, the ease at which a given rock can be crushed, scraped, chipped or indented is known as its drillability. Drillability depends on elastic and strength properties of the material. In particular, the unconfined compressive strength (UCS) of rock is recognized in the industry as an important if not sole factor to be used in determining its drillability. Realistically, however, drillability involves a large number of factors, including physical, mechanical, and micro-structural properties. The micro-structure of rock becomes particularly important when the size of the chips generated are near the grain size level. The macro-structure (e.g. bedding planes, interbeddedness, rattiness characterized using log data) is often times absent in relatively small diameter drilling holes, but if present it can significantly influence the drilling process. These and other factors affecting drillability, however, are often overlooked such that drillability of rock is often inaccurately expressed solely in terms of its UCS. There is, therefore, a need in the art for an efficient and systematic way to express the drillability of rocks comprehensively. This can be particularly important with respect to carbonate rocks.

The microstructure of rock is defined by its mineral components, grain shapes, sizes and their interlocking or packing (a.k.a. texture). Minerals are naturally occurring inorganic compounds and are present in the grains, grain-boundaries and as cementing material between two or more grains. Contrary to the fixed proportions of atoms, molecules or ions, as dealt with in chemistry, rocks are mainly solid solutions of silicates, carbonates, oxides, etc. Some of the inorganic elements get replaced in course of rock formations, and thus, the elements are typically represented in parenthesis to represent rock, as nearly as possible. The exact portion, however, is difficult to present. The individual minerals get crystallized and get crowded until they make a rigid mass of shapeless lumps called grains. Most of the minerals constituting rocks are silicates, e.g., quartz, feldspar, mica, clay, calcite, dolomite, olivine, garnet, pyroxenes, and amphiboles. The basic building block of silicate is Silicon-oxygen tetrahedron being linked in a single- or double-chain, sheets, a three-dimensional network, or not linked at all. Their bond structure, in combination with the characteristic cleavage property, makes a rock strong or weak. Minerals in sedimentary rocks are typically carbonates in addition to quartz and clay. Sulphate minerals are typical in gypsum and anhydrite.

About 99 percent of the sedimentary rocks consist of quartz, clay and carbonates resulting from sedimentary processes, such as weathering, transportation, sorting, and deposition, compaction and its typical diagenesis, up to the present age. The dominance of these individual minerals depends on the location where they were formed. For example, sandstone mainly consists of broken pieces, well sorted, un-weathered quartz. The fine sand and clay are transported more in suspension as they travel down the stream, thus forming shale. The dissolved portion of the lime and carbonate travels much further with the water. The calcite is deposited because plants and animals extract it from sea water and use it to build their skeleton. The other common rocks associated with shale sandstone and carbonates include coal, salt, gypsum, phosphate, chert and conglomerate. A large body of knowledge exists in the literature dealing with clastic rocks such as sandstones. As a result there are several models which can be used to predict the behavior or rocks from one basin to other, albeit with limited success. In contrast, relatively few works have been accomplished dealing with carbonate rocks.

Carbonate rocks, in general, are significantly different than other sedimentary rocks of sandstone or shale, due to their typical diagenesis processes including compaction, cementation, precipitation, dissolution, re-crystallization, dolomitization, or replacement of some constitutive minerals or fluids by other elements in the space available including in and around grains. Due to these typical diagenesis processes, porosity may be either reduced (dolomitization causes shrinkage by ~12.5%), or enhanced (moldic porosity, fracturing, vug or cavity formation), and/or a discontinuity may be formed as in stylolytes, like the horizontal layers seen in Carthage marble, or extended as in caverns or vugs. For example, in the Jurassic Arab limestone of Ghawar field in Saudi Arabia, replacement has caused a reduction in primary porosity. In the Jurassic Smackover Formation of Alabama and the Leduc reef carbonates in Alberta, porosity and permeability were preserved due to the existence of a rigid framework formed during early dolomitization. In general, however, dolomitization enhances porosity because dolomites are denser, and consequently, take up less volume than the original calcite. Accordingly, recognized by the Applicants is that lessons learned in one carbonate rock does not apply to others, and that such lessons are case specific, in contrast to lessons learned with respect to the majority of sandstone and shale rocks. There is, therefore, a need for an efficient and systematic way to ascertain drillability of each significant rock formation for a specific target hole section.

Conventionally, carbonate rocks have been characterized by providing qualitative rather than quantitative information. That is, typical carbonate rock characterization consists of communicating as much information as possible with respect to the depositional environments of carbonates and its evolutions, together with its constitutive mud, cement and grain network. These are gathered from testing the rock with dilute hydrochloric acids, and observing the rock under binocular microscopes, or hand lenses. Traditionally, Folk (1959) and Dunham (1962) are the only two classification systems for characterizing carbonates. Some of the recent work by Akbar et. al. (2001) and Embry and Klovan (1971), however, enhance and clarify the classification systems with more details of grain sizes and pore systems in albeit a qualitative way. Further, the work of Choquette and Pray (1970) and Lucia (1983) adds to the aspects of porosity and grain sizes, but with limited success due to complex nature of carbonates. Further, some of the recent works on above classifications have added grain sizes, pore types and porosity which altogether clarify and characterize carbonates in a much better way; albeit still in a descriptive way. Accordingly, unlike sandstones which are characterized by grain sizes only, there is no general procedure to characterize carbonate rocks (in general), as the carbonate rocks of one place may be completely different than that found at other places, and as the lessons learned on one carbonate rock would not be able to be readily used for other carbonates. There is, therefore, a need for an efficient and systematic way to quantitatively characterize and evaluate rocks (including carbonate rocks) on a case-by-case basis in order to objectively evaluate drillability.

In the oil and gas industry, drilling bits such as, for example, polycrystalline diamond compact (PDC) drilling bits, are generally selected based on design features. These design features can include, for example, blade count, cutter count, cutter size, gauge design (length, geometry), nozzle count, face volume, and junk slot area. Performance characteristics and not design features, however, directly determine the success of a design in a given application. Examples of performance characteristics can include the level of dynamic stability (e.g. torsional stability, lateral stability), axial and lateral aggressiveness, mechanical efficiency, cleaning efficiency, cooling efficiency, erosion resistance, impact resistance, and abrasion resistance. As a result of the focus on design features rather than performance characteristics, bit selection has involved a trial-and-error approach. There is, therefore, a need in the art for an efficient and systematic way to capture and compare performance characteristics for drilling bits to performance requirements associated with a target hole section of rock to facilitate bit design optimization and selection.

SUMMARY

In view of the foregoing, various embodiments of the present invention provide a system, program product, and method for bit design optimization and selection considering detailed characterizations of the formations being drilled. Various embodiments of the present invention include a computer model and image expressing the drillability of a target section in terms of physical, mechanical, and micro-structural properties determined from component subterranean formation data. Various embodiments of the present invention further include a computer model and image of the critical drilling bit performance characteristics responsive to the physical, mechanical, and micro-structural properties of the target section. This model and image employ a bit design space approach, in which each of plurality of performance characteristics is normalized and then plotted on its own axis forming, for example, a spider graph, allowing for easy comparison by human or computer. Various embodiments of the present invention include selection of a drilling bit from an assembled library of computer models and spider graphs of drilling bit characteristics for a suite of drilling bit designs having various features/configurations. Various embodiments of the present invention further allow modification to the drilling bit design features to optimize the critical drilling bit performance characteristics.

Specifically, various embodiments of the present invention provide methods of selecting a drilling bit for drilling an identified target hole section of earth containing one or more formations. According to an embodiment of the method, the method can include the steps of determining a formation property value for each member of a set of a plurality of formation properties for each of the plurality of formations forming the target hole section to thereby define a plurality of sets of formation properties, and determining a drillability parameter value of each member of a set of individual formation drillability parameters for each separate one of the plurality of formations forming the target hole section responsive to the plurality of sets of formation properties to thereby define a plurality of sets of individual formation drillability parameters. The method can also include the steps of combining each of the plurality of sets of individual formation drillability parameters to thereby represent the target hole section with a set of combined drillability parameters, determining a performance attribute value for each of a plurality of performance attributes describing target hole section performance requirements of the target hole section for drilling the target hole section responsive to the set of combined drillability parameters to thereby define a set of target hole section performance requirements, and generating a multidimensional performance attribute map of the target hole section performance requirements responsive to the step of determining the target hole section performance requirements.

The method could also include the steps of determining a performance attribute value of each of a plurality of performance attributes describing drilling system performance characteristics associated with a preselected drilling system for drilling the target hole section to thereby define a set of drilling system performance characteristics, and generating a multidimensional performance characteristics map of the drilling system performance characteristics responsive to the step of determining the drilling system performance characteristics.

The method can further include the steps of combining the set of target hole section performance requirements and the set of drilling system performance characteristics to determine a performance attribute value for each of a plurality of performance attributes describing performance characteristics of an ideal or optimal drilling bit for drilling the target hole section with the preselected drilling system to thereby define a set of drilling application performance requirements, and generating a multidimensional performance requirements map of the drilling application performance requirements responsive to the step of combining the set of target hole section performance requirements and the set of drilling system performance characteristics.

The method could also include the steps of determining a performance attribute value of each of a plurality of performance attributes describing drilling bit performance characteristics associated with a preselected drilling bit for each of a plurality of candidate drilling bits responsive to a plurality of drilling bit features to thereby define a plurality of sets of drilling bit performance characteristics, and generating a performance characteristics map of the drilling bit performance characteristics for each separate one of the plurality of candidate drilling bits to thereby define a plurality of drilling bit performance characteristics maps.

The method can still further include performing a multi-objective optimization between the set of drilling application performance requirements and each set of drilling bit performance characteristics to identify one or more of the plurality of candidate drilling bits having a substantial alignment between the set of drilling application performance requirements and the respective set of drilling bit performance characteristics to thereby select a best match drilling bit for drilling the target hole section, providing a rank ordered list of candidate drilling bits responsive to performing the multi-objective optimization, and generating a multidimensional map comprising a drilling application performance requirements map of the drilling application performance requirements overlaid with at least one of a plurality of drilling bit performance characteristics maps of the drilling bit performance characteristics to thereby provide a multidimensional visual comparison between the drilling application performance requirements and drilling bit performance characteristics for at least one of the plurality of candidate drilling bits.

The method can also or alternatively include the steps of generating at least one virtual drilling bit model having a plurality of adjustable (selectable) virtual drilling bit features responsive to a virtual library including the plurality of adjustable virtual drilling bit features, and performing a multi-objective optimization between the set of drilling application performance requirements and each of the plurality of adjustable virtual drilling bit features to thereby determine feature attributes of the plurality of drilling bit features that when combined to form a candidate virtual drilling bit provide the candidate virtual drilling bit with drilling bit performance characteristics substantially coinciding with the determined drilling application performance requirements to thereby provide a virtual design for an optimal drilling bit defining a candidate optimal drilling bit for drilling the target hole section.

The method can further include determining drilling bit performance characteristics of the candidate optimal drilling bit, and generating a multidimensional map comprising a drilling application performance requirements map of the drilling application performance requirements overlaid with a drilling bit performance characteristics map of the drilling bit performance characteristics of the candidate optimal drilling bit to thereby provide a multidimensional visual comparison between the drilling application performance requirements and drilling bit performance characteristics for the candidate optimal drilling bit.

Various embodiments of the present invention also provide bit selection and design program product stored in a tangible computer medium to select a drilling bit for drilling an identified target hole section of earth containing one or more formations. According to an embodiment of the bit selection and design program product, the program product can include instructions that when executed by a computer, cause the computer to perform the operations of determining a performance attribute value for each of a plurality of performance attributes describing target hole section performance requirements of the target hole section for drilling the target hole section responsive to a set of drillability parameters to define a set of target hole section performance requirements to thereby define a set of drilling application performance requirements, determining a performance attribute value of each of a plurality of performance attributes describing drilling bit performance characteristics associated with a preselected drilling bit for each of a plurality of candidate drilling bits responsive to a plurality of drilling bit features to thereby define a plurality of sets of drilling bit performance characteristics, and performing a multi-objective optimization between the set of drilling application performance requirements and each set of drilling bit performance characteristics to identify one or more of the plurality of candidate drilling bits having a substantial alignment between the set of drilling application performance requirements and the respective set of drilling bit performance characteristics to thereby select a best match drilling bit for drilling the target hole section.

The operations can also include providing data to display a rank ordered list of candidate drilling bits responsive to performing the multi-objective optimization, and generating a multidimensional map comprising a drilling application performance requirements map of the drilling application performance requirements overlaid with at least one of a plurality of drilling bit performance characteristics maps of the drilling bit performance characteristics to thereby provide a multidimensional visual comparison between the drilling application performance requirements and drilling bit performance characteristics for at least one of the plurality of candidate drilling bits.

According to another embodiment of the program product, the operations can include determining a performance attribute value for each of a plurality of performance attributes describing performance requirements of the target hole section for drilling the target hole section responsive to a set of drillability parameters, to define a set of target hole section performance requirements to thereby define a set of drilling application performance requirements, and receiving at least one virtual drilling bit model having a plurality of adjustable virtual drilling bit features responsive to a virtual library including the plurality of adjustable virtual drilling bit features. At least one of the plurality of adjustable drilling bit features can include a plurality of selectable virtual versions having a different size, shape, or quantity selectable within a continuum of values. The operations can also include performing a multi-objective optimization between the set of drilling application performance requirements and each of the plurality of adjustable virtual drilling bit features to thereby determine feature attributes of the plurality of drilling bit features that when combined to form a candidate virtual drilling bit provide the candidate virtual drilling bit with drilling bit performance characteristics substantially coinciding with the determined drilling application performance requirements. That is, the candidate virtual drilling bit providing a virtual drilling bit design for an optimal drilling bit defining a candidate optimal drilling bit for drilling the target hole section.

The operations can further include determining drilling bit performance characteristics of the candidate optimal drilling bit, and generating a multidimensional map comprising a drilling application performance requirements map of the drilling application performance requirements overlaid with a performance characteristics map of the drilling bit performance characteristics for the candidate optimal drilling bit to thereby provide a multidimensional visual comparison between the drilling application performance requirements and drilling bit performance characteristics for the candidate optimal drilling bit.

According to another embodiment of the program product, the operations can include determining a formation property value for each member of a set of a plurality of formation properties for each formation forming the target hole section to thereby define at least one set of formation properties, determining a drillability parameter value of each member of a set of individual formation drillability parameters for each separate one of the plurality of formations forming the target hole section responsive to the plurality of sets of formation properties to thereby define a plurality of sets of individual formation drillability parameters, and combining each of the plurality of sets of individual formation drillability parameters to thereby represent the target hole section with a set of combined drillability parameters. The operations also include determining a performance attribute value for each of a plurality of performance attributes describing target hole section performance requirements of the target hole section for drilling the target hole section responsive to the set of combined drillability parameters to thereby define a set of target hole section performance requirements, determining a performance attribute value of each of a plurality of performance attributes describing drilling system performance characteristics associated with a preselected drilling system for drilling the target hole section to thereby define a set of drilling system performance characteristics, and combining the set of target hole section performance requirements and the set of drilling system performance characteristics. The operations also include, responsive to the operation of combining the set of target hole section performance requirements and the set of drilling system performance characteristics, determining a performance attribute value for each of a plurality of performance attributes describing performance characteristics of an optimal drilling bit for drilling the target hole section with the preselected drilling system to thereby define a set of drilling application performance requirements.

Various embodiments of the present invention also provide systems for selecting and optimizing a drilling bit for drilling an identified target hole section of earth containing at least one formation. An example of an embodiment of such a system can include a computer having a processor, memory coupled to the processor, and various embodiments of the drilling bit selection and optimization program product stored in the memory of the computer including instructions that when executed by the computer, cause the computer to perform the foregoing selecting and optimizing functions.

BRIEF DESCRIPTION OF THE DRAWINGS

So that the manner in which the features and advantages of the invention, as well as others which will become apparent, may be understood in more detail, a more particular description of the invention briefly summarized above may be had by reference to the embodiments thereof which are illustrated in the appended drawings, which form a part of this specification. It is to be noted, however, that the drawings illustrate only various embodiments of the invention and are therefore not to be considered limiting of the invention's scope as it may include other effective embodiments as well.

DETAILED DESCRIPTION

The present invention will now be described more fully hereinafter with reference to the accompanying drawings, which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout.

Figure 1:
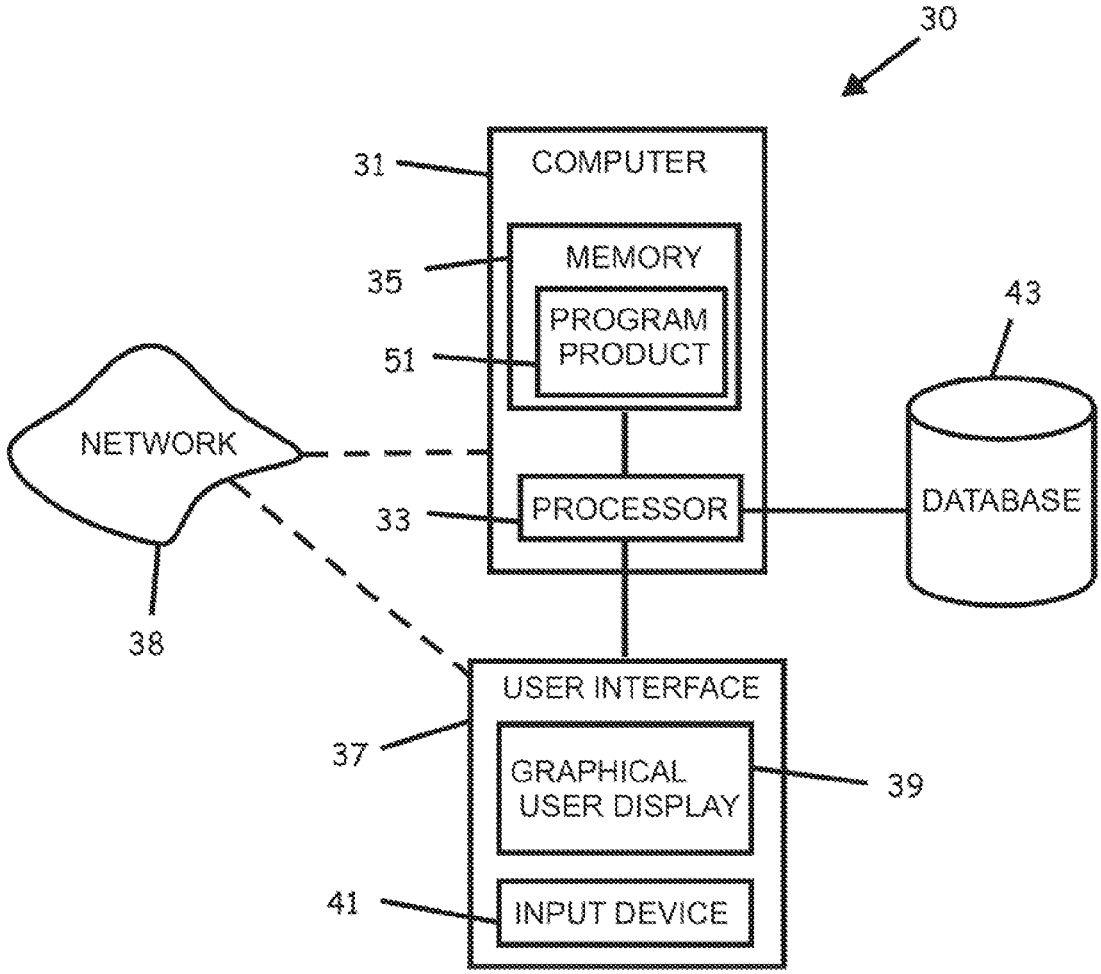
FIG. 1 is a schematic block diagram of a system to select or optimize a drilling bit for drilling an identified target hole section of earth according to an embodiment of the present invention.
Figure 2:
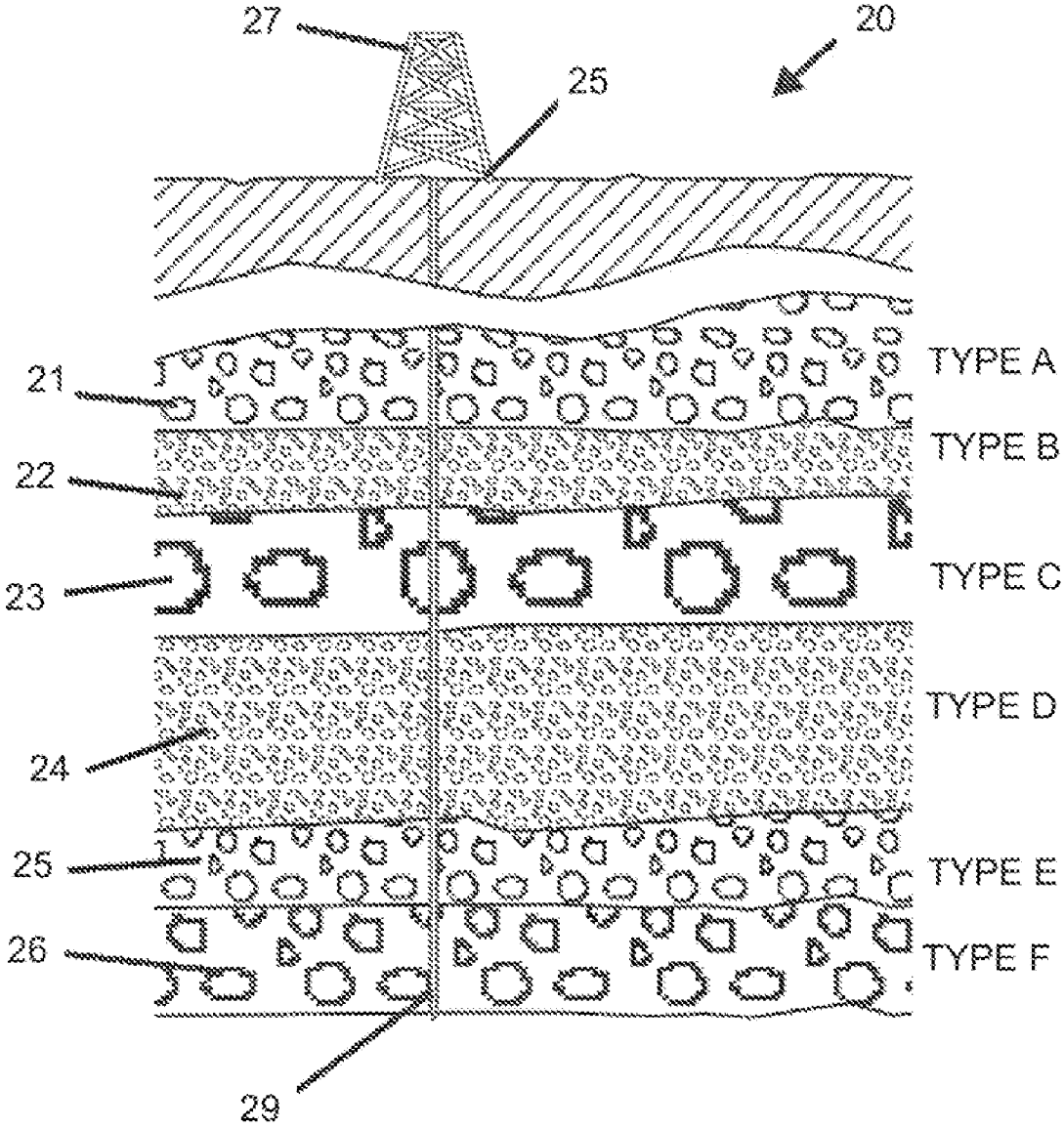
FIG. 2 is a partially sectional view and partially perspective view of an identified target hole section and its component subterranean formations selected according to an embodiment of the present invention.

As shown in FIGS. 1-17, embodiments of the present invention provide an improved system, program product, and methods of selecting a drilling bit for drilling an identified target hole section of earth containing at least one, but typically, a plurality of formations. FIG. 1, for example, illustrates a system 30 to select a drilling bit for drilling an identified target hole section 20 (see, e.g., FIG. 2) of earth having multiple formations 21-26 (Type "A"-"F"). The identified target hole section 20, for example, will typically be a hole section for a "section" of pipe such as a section of casing having a common dimension, e.g., the section of casing between 300 to 6000 feet having a 12.25 inch diameter, etc. FIG. 2 illustrates an identified target section 20 and its component subterranean formations 21-26, a drilling apparatus 27 located at the surface 28 for purposes of oil and gas extraction in a well bore 29, according to embodiments of the present invention.

Referring again to FIG. 1, the system 30 can include a computer 31 having a processor 33, memory 35 coupled to the processor 33 to store software and database records therein, and a user interface 37 which can include a graphical display 39 for displaying graphical images, and a user input device 41 as known to those skilled in the art, to provide a user access to manipulate the software and database records. Note, the computer 31 can be in the form of a personal computer or in the form of a server serving multiple user interfaces 37. Accordingly, the user interface 37 can be either directly connected to the computer 31 or through a network 38, as known to those skilled in the art. The system 30 can also include a database 43 stored in the memory 35 (internal or external) of computer 31 and having a virtual library of drilling bit models, drilling bit features of the models, and associated predetermined performance characteristics, derived, for example, via a mapping engine for each model for each combination of potential features selections.

The system 30 can also include drilling bit selection and optimization program product 51 stored in memory 35 of the computer 31 and adapted to assign values to a set of dimensions that define a "design and application space," where each of these dimensions is a quantifiable performance attribute; to quantify both drilling bits and hole sections, preferably considering drilling systems and well profiles, in terms of these dimensions/attributes; and to seek and find a drilling bit that has characteristics that map as closely as possible to the application requirements (either an existing drilling bit, or feature sets that are desirable in a new design), as will be described in more detail below.

Note, the drilling bit selection and optimization program product 51 can be in the form of microcode, programs, routines, and symbolic languages that provide a specific set or sets of ordered operations that control the functioning of the hardware and direct its operation, as known and understood by those skilled in the art. Note also, the drilling bit selection and optimization program product 51, according to an embodiment of the present invention, need not reside in its entirety in volatile memory, but can be selectively loaded, as necessary, according to various methodologies as known and understood by those skilled in the art.

Figure 3A:
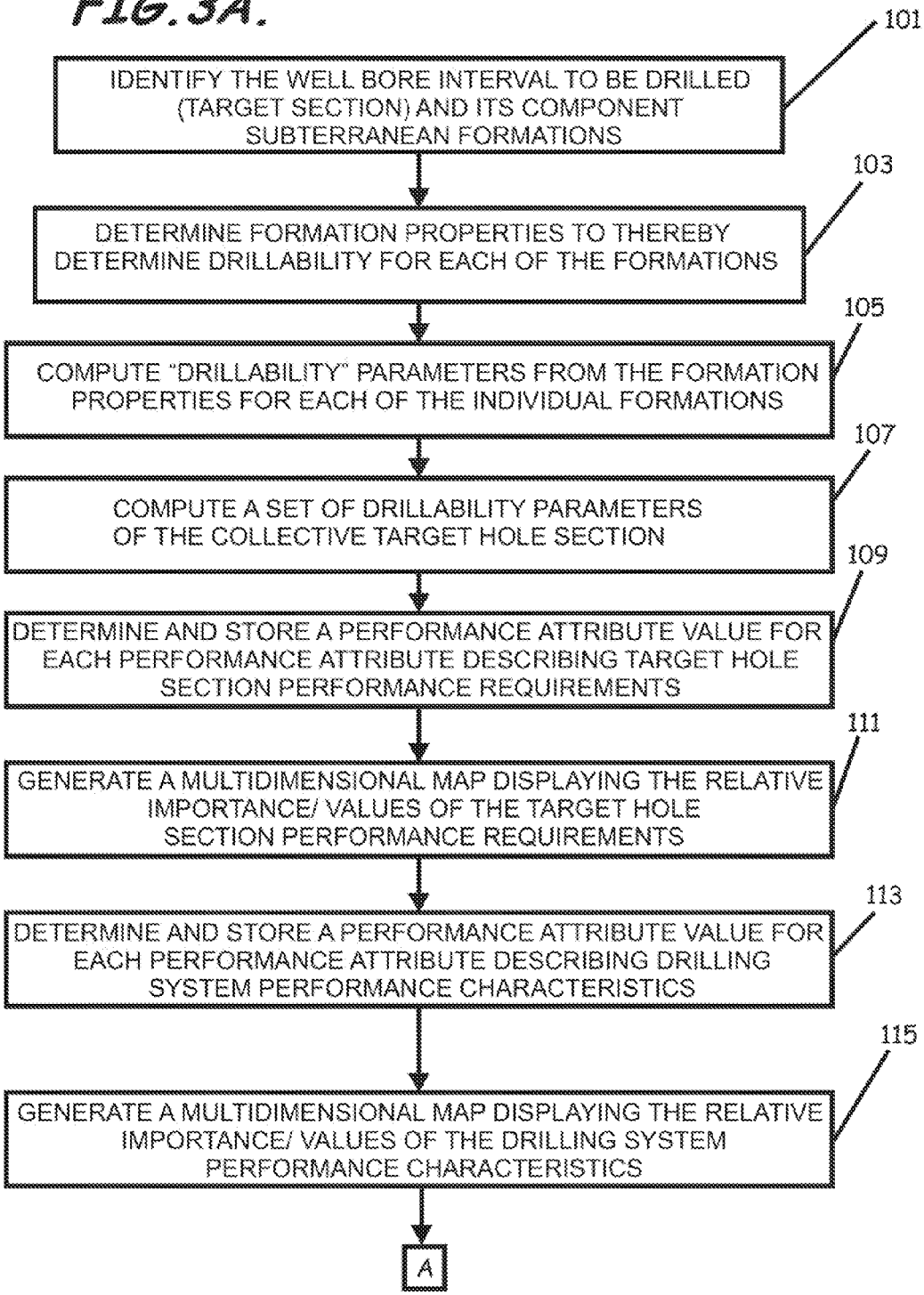
FIG. 3A-3C is a schematic flow diagram of a method to select or optimize a drilling bit for drilling an identified target hole section of earth according to an embodiment of the present invention.
Figure 3B:
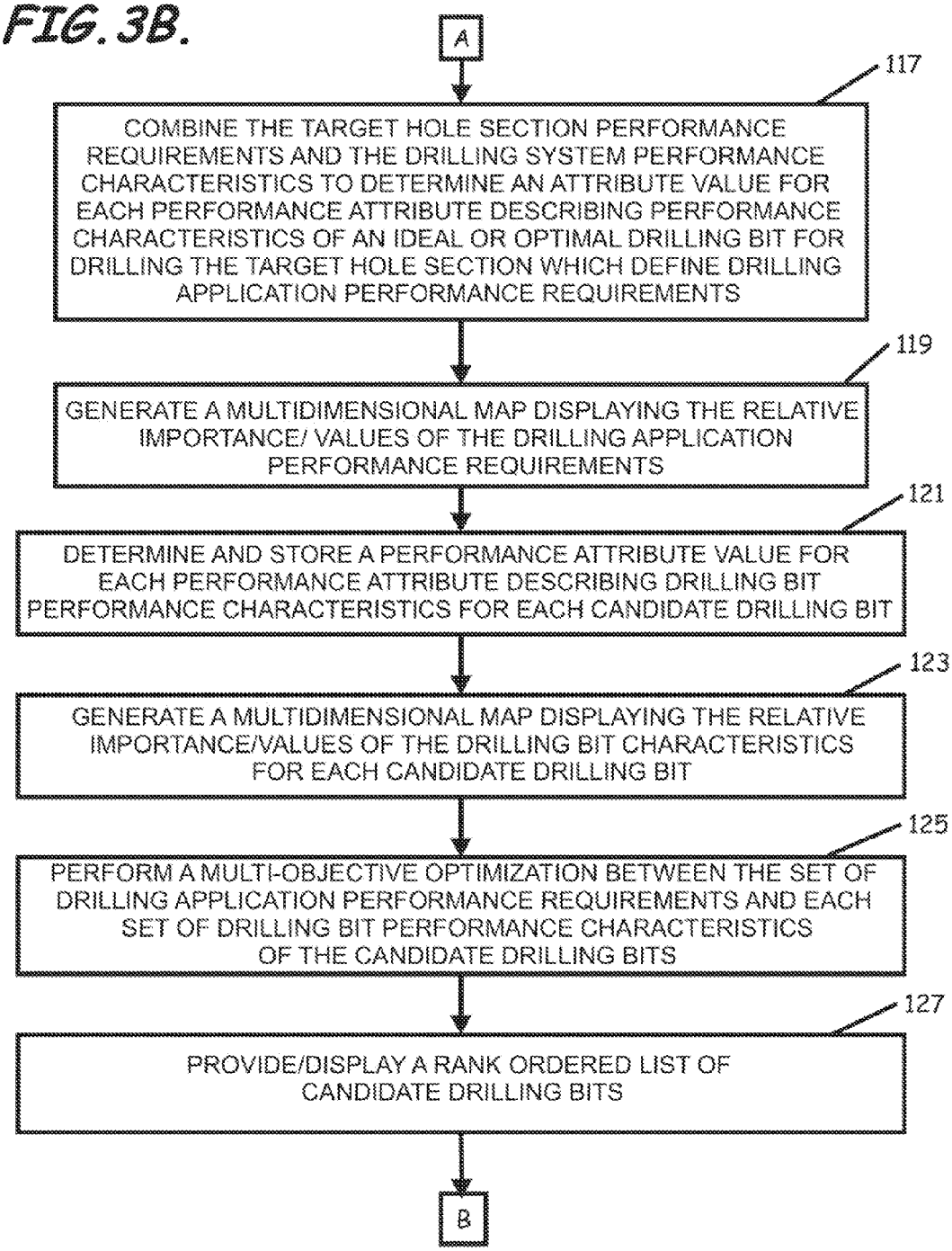
Figure 3C:
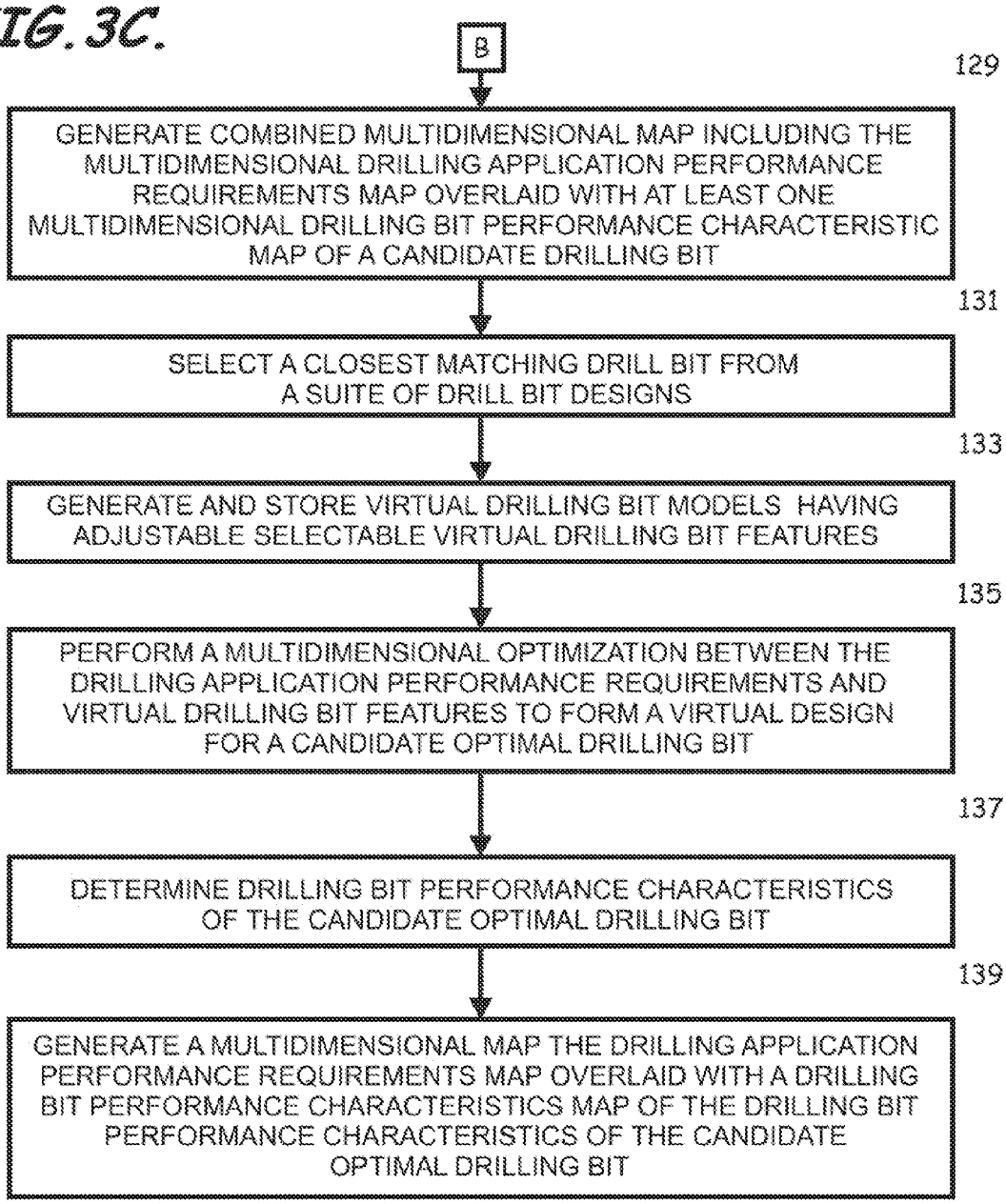

FIGS. 3A-3C illustrate a high-level flow diagram illustrating a method of selecting and optimizing a drilling bit for drilling an identified target hole section 20 of earth containing one or more formations 21-26, according to an embodiment of the present invention, most of which can be implemented by the drilling bit selection and optimization program product 51. The method begins with identifying the target sector or section 20 (i.e., the "well bore interval" to be drilled) and its component subterranean formations 21-26 (block 101). The next step includes determining or otherwise retrieving formation properties, e.g., density, porosity, compressional sonic (P), shear sonic (S), mineralogy, grain or block size and earth pressure (described below) to thereby determine drillability for each of the formations 21-26 (block 103). As shown in FIGS. 4A-4F, according to embodiments of the present invention, this step can also include generating a computer model and spider graph of the drillability for each identified subterranean formation in terms of physical, mechanical, and micro-structural properties. The formation properties (see, e.g., FIGS. 4A-4F) can be determined, for example, using log analysis and a duly calibrated model/equation to best estimate the drillability of rock or rocks. In absence of a proper model or equation, physical, mechanical, and microstructural testing from suitable core samples can provide the best estimate of drillability.

The physical properties data can include porosity, density, compressional sonic wave (P-wave) velocity or Dtc slowness, and shear sonic wave (S-wave) velocity or Dts slowness, which can be obtained through physical testing and/or log data. These properties represent the behavior of a rock in absence of load or under low level of load application. The mechanical properties can include, for example, unconfined compressed strength (UCS) and borehole pressure strengthening Mohr's friction angle (which can be indicated as a strengthening coefficient ("m")), which can be measured directly from core samples in the laboratory or calculated indirectly from log data using software (like "ROCKY") disclosed in U.S. Pat. No. 6,386,297, incorporated by reference in its entirety. The micro-structural properties considered are hard and abrasive minerals and grain sizes or block sizes. For simplicity, only quartz minerals are considered as an indicator of hardness (illustrated in FIGS. 4A-4G as % quartz (Q)). Others, such as dolomite, pyrite, hematite, and some metamorphosed minerals, directly related to abrasiveness, can also be used. Microstructural testing can yield microstructural properties including, for example, grain size and mineralogy which is representative of hardness based on hard or abrasive materials. The grain sizes also indicate strength of rocks. For example, in a given mineralogical compositions, with possibly the exception of clay, smaller grain sizes result more contact area thus stronger rocks. Each of these, e.g., eight, formation properties are described in more detail as follows:

Density: Density is a bulk property which represents mass per unit volume. Since density of an individual mineral matrix is fixed (e.g., quartz 2.65 g/cc, calcite 2.71 g/cc, dolomite 2.89 g/cc etc.), a decrease in density of rocks can be indicated of the porosity of the rock type. Further, this formation property is unaffected due to presence of cracks or fracture, especially in a closed condition. The interpretation of it, however, is not as simple as it appears. A complication arises when the rock matrix is not pure and is mixed with other mineral types. Another source of discrepancy is whether the pore space is filled with gas or one or more different kinds of fluids. Accordingly, another variation of density representing porosity and fluid saturations, e.g. bulk density, dry density, nominal saturated density, vacuum saturated density, water saturated or KCl saturated density etc., can be used. If the pore volume, water volume, and matrix volume are known, all of the interrelated parameters can be readily calculated. Therefore, density can be used to estimate UCS, and thus CCS, accordingly, with a substantial correlation therebetween. It can be assumed that the same correlation exists between log measured data of density and UCS of the formation. Due care, however, should be taken as even the log data needs some expert interpretation as presence of gas and fluids of different type may complicate the true density. As such, according to an embodiment of the present invention, density alone should not be the only parameter used to estimate UCS and or CCS. Accordingly, an embodiment of the method can include developing and referencing correlation curves between UCS and the density, and between CCS and the density along with returning a respective correlation coefficient to allow the user to assess the strength of the estimate based on the individual parameter, or altogether with other formation parameters.

Porosity: Porosity is sometimes considered one of the most usable parameters in the petroleum industry, whether for drilling, reservoir engineering, completion, or production purposes. Data for such formation parameter, however, is often difficult to obtain, as it may be confidential to operators. A proper estimate of porosity, however, may be vital for the drilling process. Fundamentally, porosity is void space or pore volume, which causes stress concentration in the deformation or failure process. Porosity also causes a decrease in modulii of elasticity, and thus wave velocity, as well. The presence of a compliant crack or fracture contributes little to porosity, but decreases the modulii of elasticity to a great extent, and can make the rock type anisotropic. The anisotropy is reflected in the S wave being horizontally and vertically polarized. The pore volume and its shapes, and even the compliant crack, can be vital for determination of strength of rock if it favors a suitable stress concentration, e.g., depending upon sharpness of pore edges and alignment of crack or fractures. In any case, porosity can be characterized in various parameters such as primary porosity, secondary porosity, fracture porosity, vuggy or channel porosity, effective porosity, etc. Approximately 17 variations of porosity related terms have been used in the literature to characterize texture, grain sorting and shape, deposition environments, high or low energy, evolution to present state, etc, which makes precise interpretation difficult. Further, the presence of gas and fluids of different types may complicate the bulk porosity values. Accordingly, an embodiment of the method can include developing and referencing correlation curves between UCS and the porosity, and between CCS and the porosity along with returning a respective correlation coefficient to allow the user to assess the strength of the estimate based on the individual parameter, or altogether with other parameters.

Compressional Sonic. Dtc: The compressional wave (P wave velocity or Dtc slowness) is the fastest wave that can travel in a rock type. This feature is easy and economic to measure and needs the least expertise in its interpretation. For this reason, it has been used to characterize rock material in other branches of engineering (rippability in civil engineering, percussion and diamond drilling in mining and estimating triaxial strength and stiffness in petroleum engineering). This feature can also be used to characterize the extent of brokenness in rock mass by taking the ratio of log derived sonic data to that of its matrix velocity. Although, the P wave is largely dependent on stiffness values, it does not remain fixed in a given rock type due to compliant cracks, fractures and pore types due to refraction, reflection and attenuation of traveling wave. As the P wave speed is very low in pore spaces (~330 m/s in air and ~1450 m/s in water) as compared to the rock matrix (~7000 m/s), the P wave gets drastically reduced in the presence of pores or voids. Some stiff rocks, however, give fixed velocity even at low confining pressure (e.g. Kingstone limestone, Solenhofen limestone and Bonne Terre dolomite). Accordingly, an embodiment of the method can include developing and referencing correlation curves between UCS and the P wave velocity, and between CCS and the P wave velocity along with returning a respective correlation coefficient to allow the user to assess the strength of the estimate based on the individual parameter, or altogether with other parameters.

Shear sonic, Dts: The shear sonic wave (S wave or Dts) is much slower than the P wave. In an isotropic material, the S wave is largely influenced by Poisson's ratio, which is affected by the micro- and macro-structure, and fluid saturation. In anisotropic material it may be vertically and horizontally polarized. Further, measurement of S wave is more complicated and costly and may require the use of costly transducers to filter the accompanying surface and stonely waves, which, together with the reflected and refracted P waves, form at joint or bedding planes. Therefore, due care should be taken in its interpretation. S waves have been found through testing, according to an embodiment of the method, to indicate complicated behavior at low confining pressure, which is largely due to compliant crack closure, grain adjustments or possible reflection, refraction and attenuation at various sites. Further, such testing has shown that stiff rocks show almost no change in velocity, but at the same time, fail to show isotropic behavior (two S waves merging) even at high confining pressure. Accordingly, an embodiment of the method can include developing and referencing correlation curves between UCS and the S wave velocity, and between CCS and the S wave velocity along with returning a respective correlation coefficient to allow the user to assess the strength of the estimate based on the individual parameter, or altogether with other parameters.

Mineralogy: Mineralogy plays a significant role in wear and balling characteristics in drilling. For example, quartz, being the hardest mineral in common rock types, causes extensive wear, where clay, due to its affinity to moisture and swelling characteristics, causes balling. Due recognition and quantification of these minerals, already determined via core samples and log measurements, provides a much better characterization of the rock type. For example, gamma-ray analysis can indicate the presence of clay or shale. Furthermore, log data of uranium, thorium and potassium can be used to indicate type of clay, such as kaolinite, illite, smectite, montmorillonite, etc. According to an embodiment of the method, however, individual minerals are quantified from thin section or X-Ray Diffraction analysis. It should be noted that both quartz, as well as clay, are absent in carbonate rocks. In such cases, other common but vital minerals can be quantified (e.g. dolomite, pyrite, ankerite, etc). With respect to UCS, particularly in carbonic rocks, a higher UCS has been found to correspond with a higher value of Vickers Hardness Rock Number (VHRN) formed from the respective Vickers hardness number and a cumulative average thereof for each type of rock. Accordingly, an embodiment of the method can include developing and referencing correlation curves between UCS and the mineralogy (VHRN), and between CCS and the mineralogy (VHRN) along with returning a respective correlation coefficient to allow the user to assess the strength of the estimate based on the individual parameter, or altogether with other parameters. Notably, the resulting correlation coefficient improves very much when combined with porosity.

Grain or Block size: Grain sizes and block sizes are among the most important features of the microstructure having relevance in drilling, but are analyzed the least. One factor is the difficulty in collecting and measuring such features both in core sample as well as in log measurements. Block size can be even more important when rocks are highly interbedded, as it shows brokenness of the rock formation. Grain size can be more important in absence of block or joint sizes. In either case, both grain size and block size are reflected in bulk properties such as wave velocity, density, porosity, etc. Notably, as carbonate rocks are generally not crystalline in nature, grain size tends to vary widely, making it difficult to ascertain a representative value. Accordingly, an embodiment of the method can include developing and referencing correlation curves between UCS and the grain size or block size, and between CCS and the grain size or block size along with returning a respective correlation coefficient to allow the user to assess the strength of the estimate based on the individual parameter, or altogether with other parameters.

Unconfined compressive strength, UCS: UCS is considered to be a fundamental property, and is widely used in the drilling industry. UCS represents the maximum stress sustained in a uniaxial loading condition beyond which load carrying capacity decreases drastically until physical disconnection between broken pieces occurs. Further, since the amount of strain sustained in compressive loading is about 0.2-0.5% only, the slope of the line in stress-stress space (Young's modulus of elasticity) is also proportional to UCS. This direct correlation of the Young's modulus with UCS also indicates that sonic velocity is proportional to UCS. Further, as the area (of a plot) between stress and strain is the energy consumed in the destruction process, for a given strain value at failure, the UCS reflects deformation and destruction energy. If the compressive strength is measured under confinement, as noted previously, it is termed as CCS. Several additional characteristics can be obtained in a full suit of CCS "strength" testing. Accordingly, an embodiment of the method can include developing and referencing correlation curves between USC and deformation, axial strain, or other characteristics, and between CCS and deformation, axial strain, or other characteristics along with returning a respective correlation coefficient to allow the user to assess the strength of the estimate based on the individual parameter, or altogether with other parameters. Such correlative analysis has shown that the effect of pore pressure and confining pressure oppose each other. Thus, CCS can be considered to depend upon a net differential pressure.

Mohr Friction Angle: The Mohr-Coulomb diagram is one of the effective ways to graphically visualize normal stress and shear stress along a failure plane. Very limited works exists in the literature, however, on the Mohr's Friction Angle and its correlation with other rock properties. Particularly, there is no consensus on definition of "friction angle." Some call it an internal friction angle, some call it coefficient of friction angle. Further, some calculate it using a simple moving block on a horizontal table and by measuring the ratio of tangential load to normal load. Further, some use a standard "shear-box" system, and some calculate it as the slope of the line on a Mohr-Failure envelope, etc. An embodiment of the method considers the latter as a true reflection of that which it embodies for calculating confined compressive strength. The slope of the line is called "Mohr-Friction Angle-Ø." The same plot can also be visualized in a maximum and minimum principal stress plot. In the former the Y-intercept is cohesion or shear stress at zero confining pressure, and slope is the Mohr-Friction Angle; whereas in the latter, the Y-intercept is UCS and the slope is equivalent to the Mohr-friction angle. Although, the slope of the line in the latter condition can be different than that of the former, it can, nevertheless, be used directly to calculate the Mohr-Friction Angle. This friction angle is highest at low confining pressure and it decreases continually at high confining pressure. For all practical purposes, i.e., in the borehole pressure environment where drillability is investigated, however, it can be assumed to be a straight line. Accordingly, an embodiment of the method can include developing and referencing correlation curves between USC and Mohr-Friction Angle, and between CCS and Mohr-Friction Angle along with returning a respective correlation coefficient to allow the user to assess the strength of the estimate based on the individual parameter, or altogether with other parameters. Note, such correlation curves have indicated an inverse relationship between the Mohr-Friction Angle and porosity in a wide variety of sandstones and carbonate rock types.

Figure 4A:
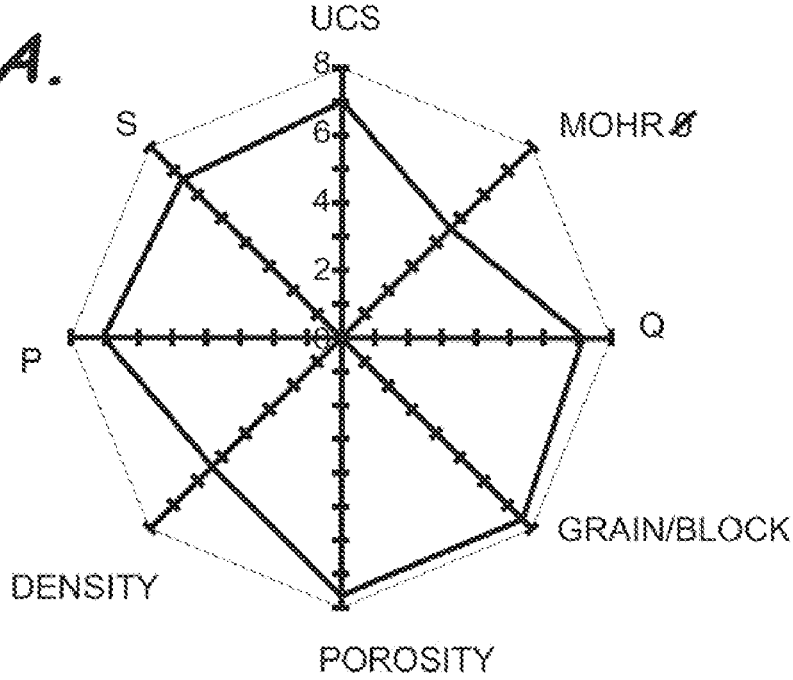
FIGS. 4A-4F are graphical diagrams of an eight-dimensional map or graph displaying physical, mechanical, and micro-structural properties for each separate one of the subterranean formations of FIG. 2 according to an embodiment of the present invention.
Figure 4B:
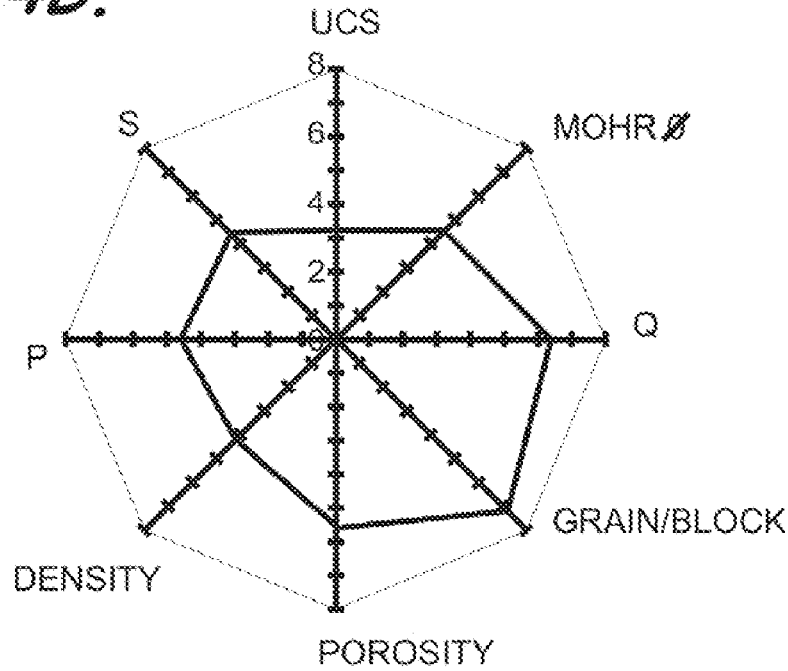
Figure 4C:
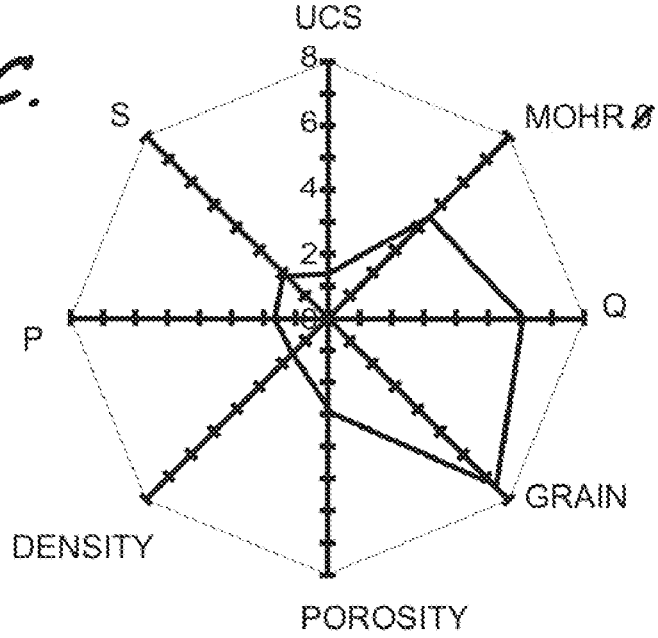
Figure 4D:
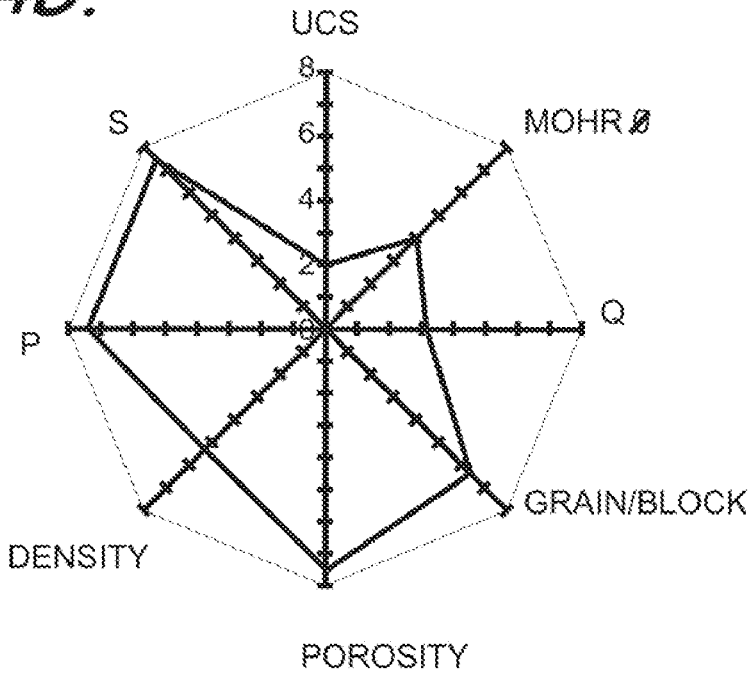
Figure 4E:
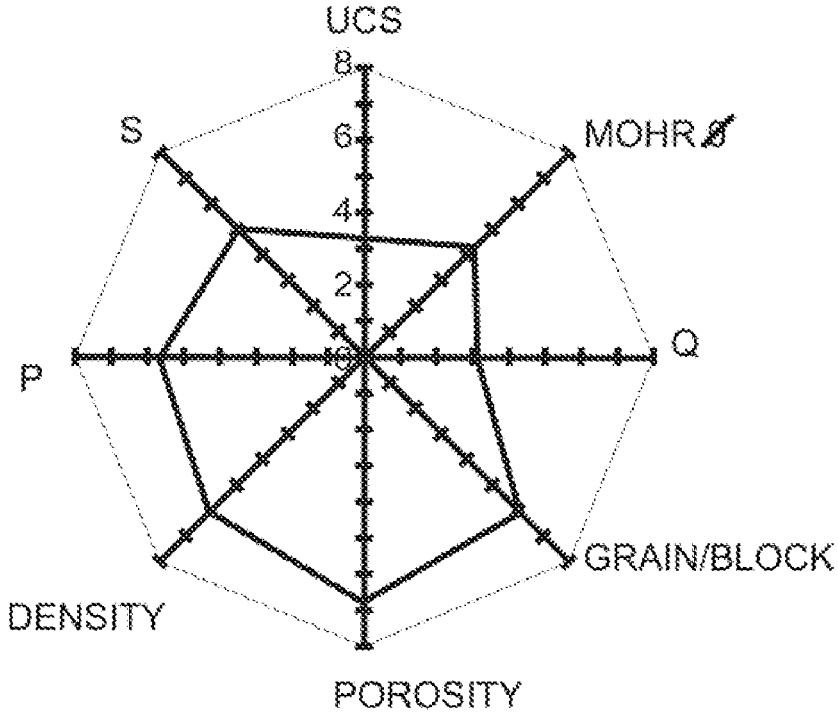
Figure 4F:
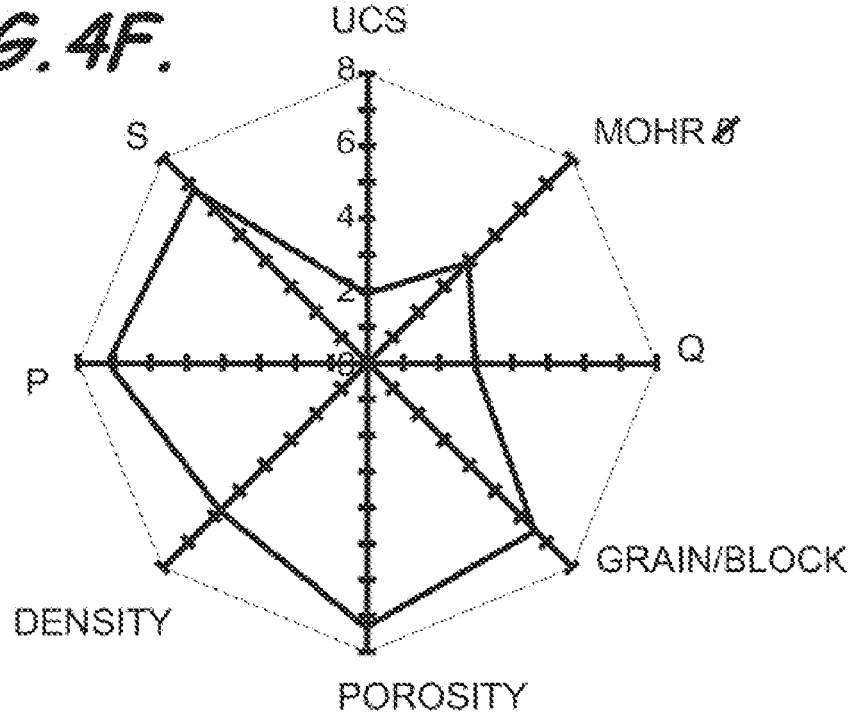
Figure 4G:
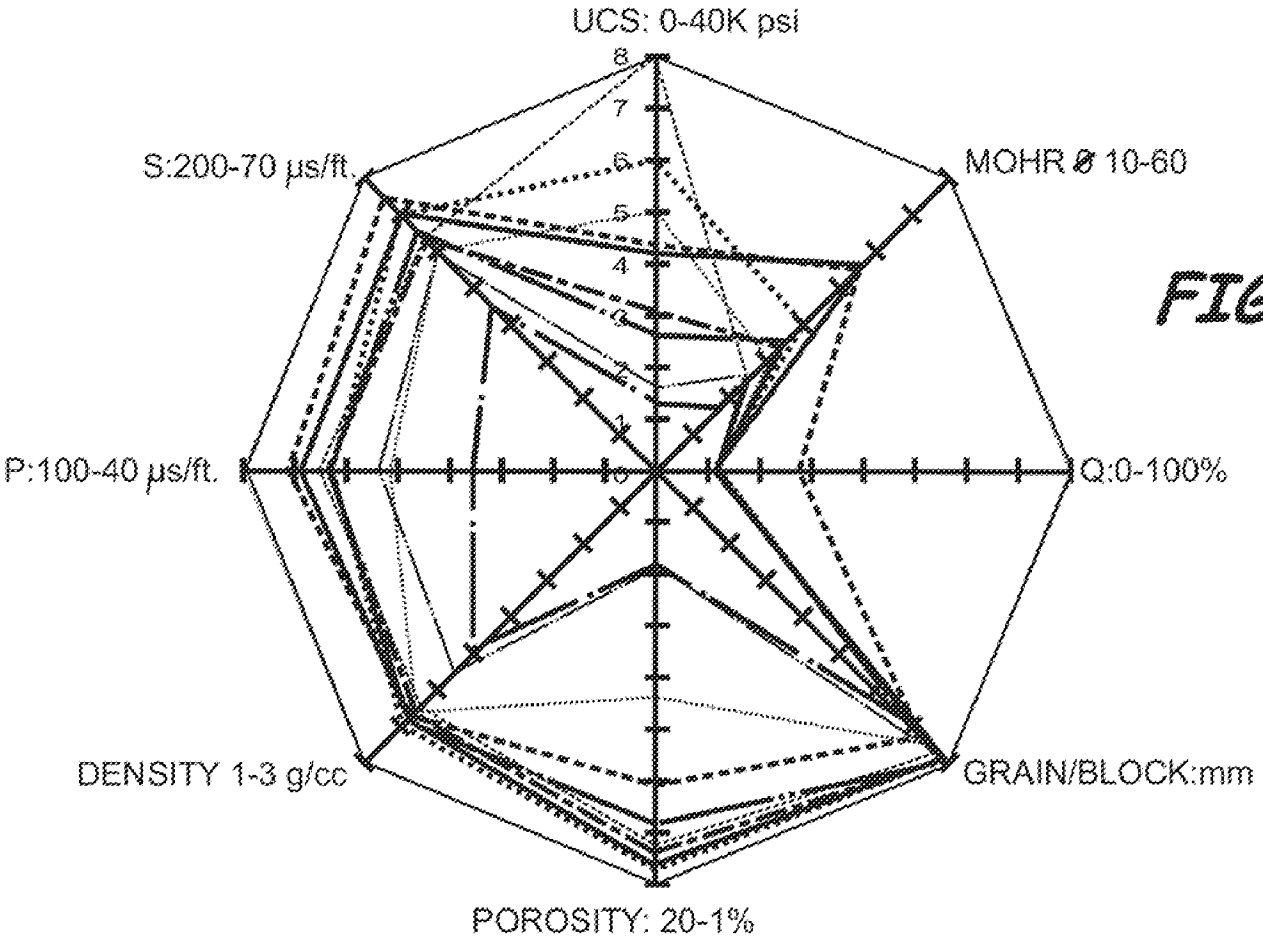
FIG. 4G is a graphical diagram of a combined eight-dimensional map or graph displaying physical, mechanical, and micro-structural properties for each of the subterranean formations of FIG. 2 according to an embodiment of the present invention.
Figure 5A:
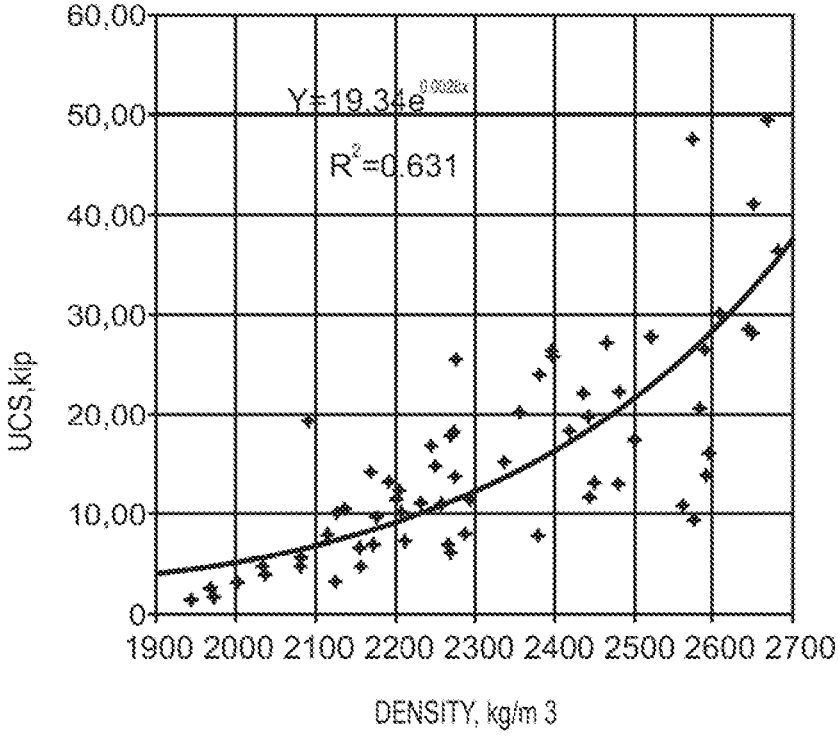
FIGS. 5A-D are graphical diagrams illustrating a methodology of estimating the unconfined compressed strength (UCS)/Strengthening coefficient for 140 Sandstone from Density, Porosity, P- and S-waves according to an embodiment of the present invention.
Figure 5B:
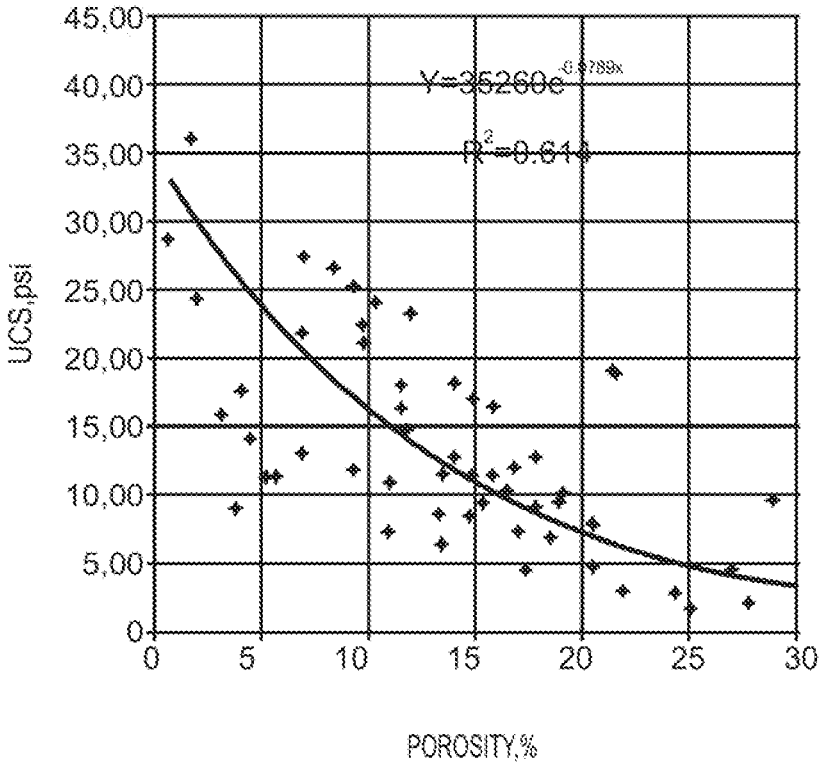
Figure 5C:
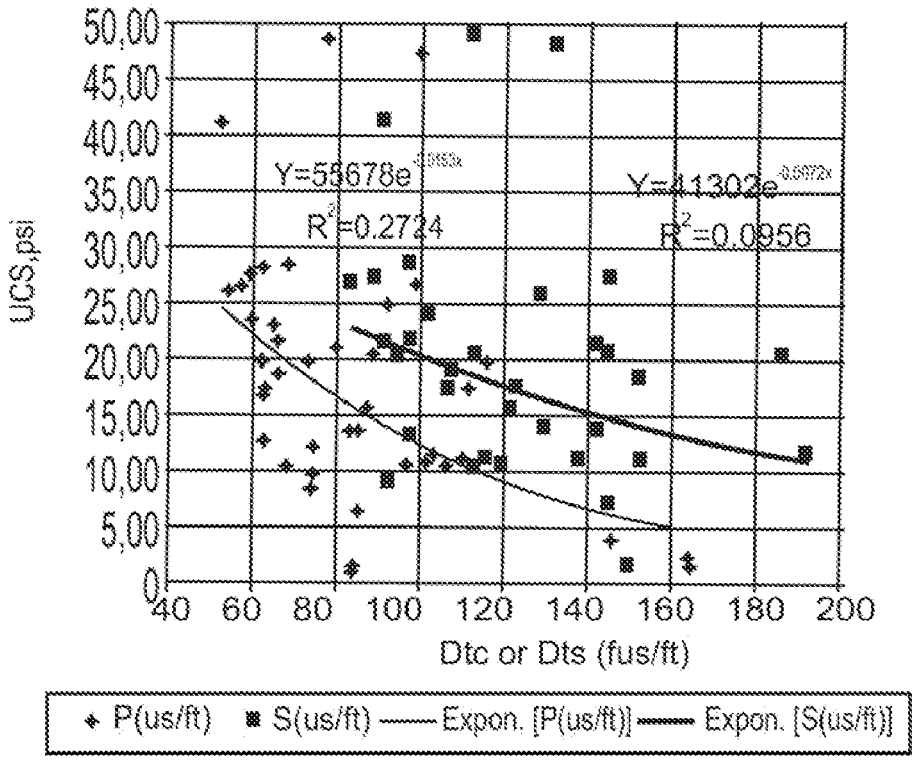
Figure 5D:
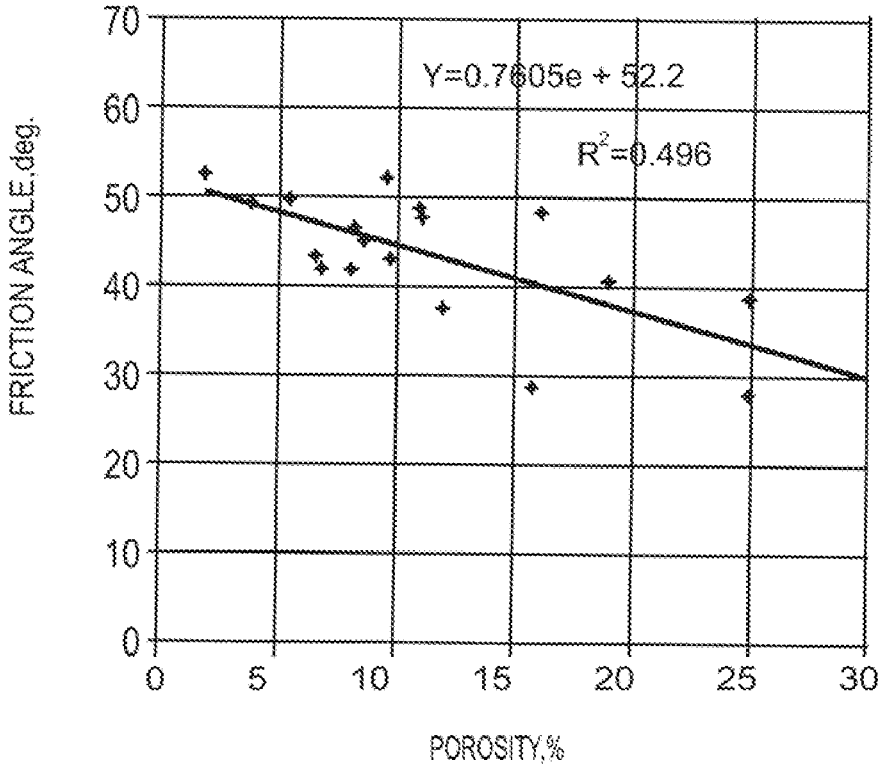
Figure 6A:
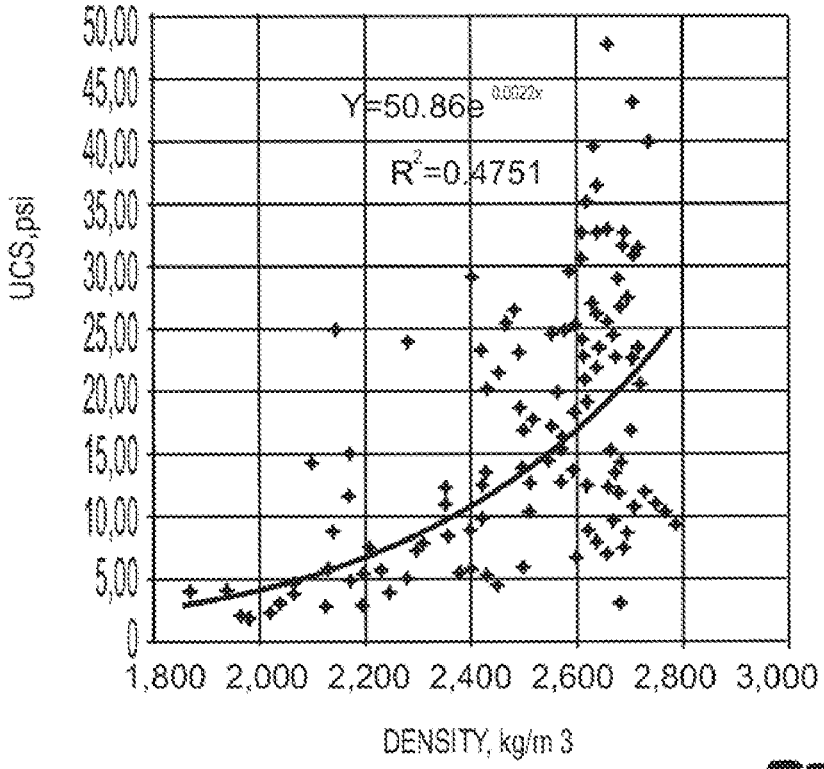
FIGS. 6A-D are graphical diagrams illustrating a methodology of estimating the unconfined compressed strength (UCS)/Strengthening coefficient for 184 Limestone from Density, Porosity, P- and S-waves according to an embodiment of the present invention.
Figure 6B:
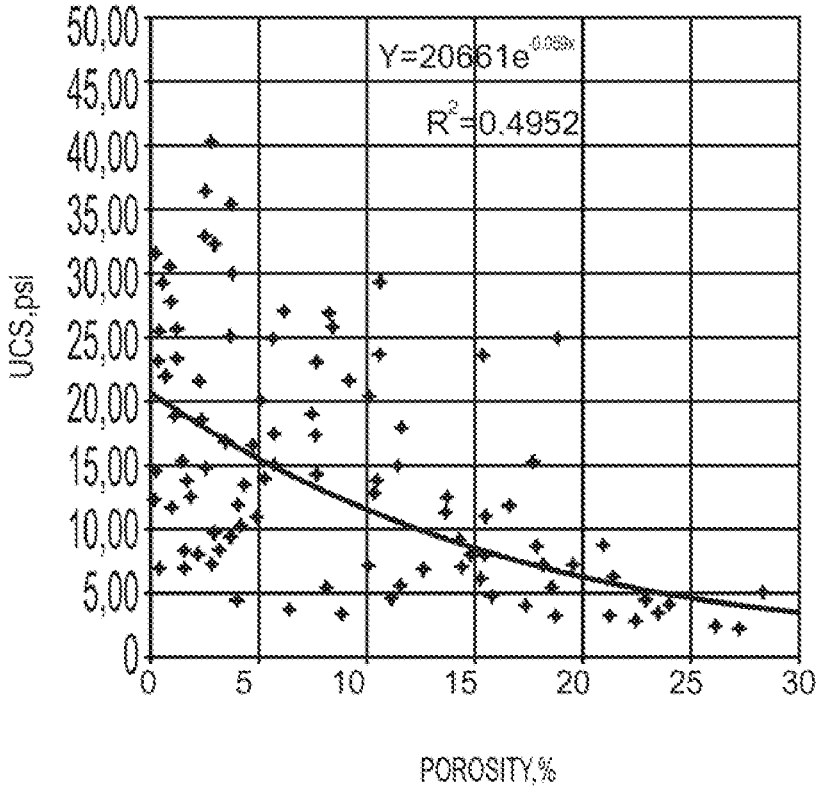
Figure 6C:
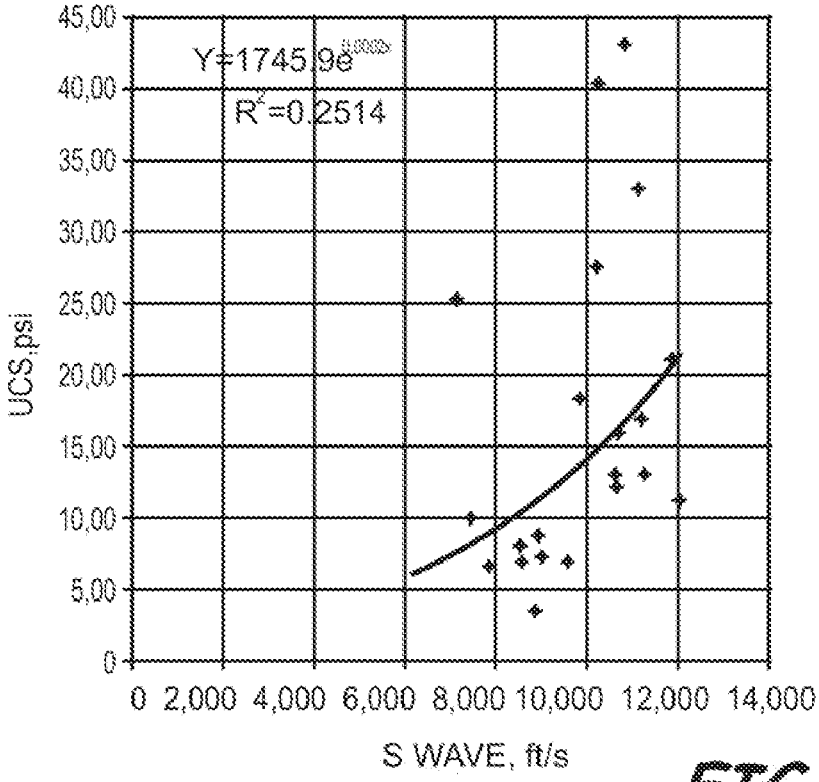
Figure 6D:
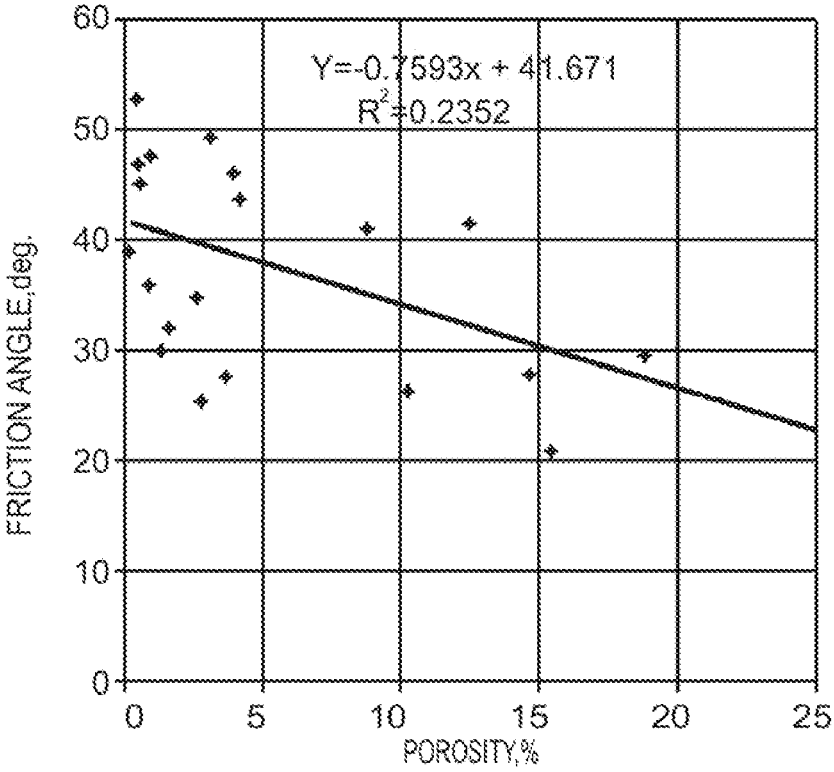
Figure 7A:
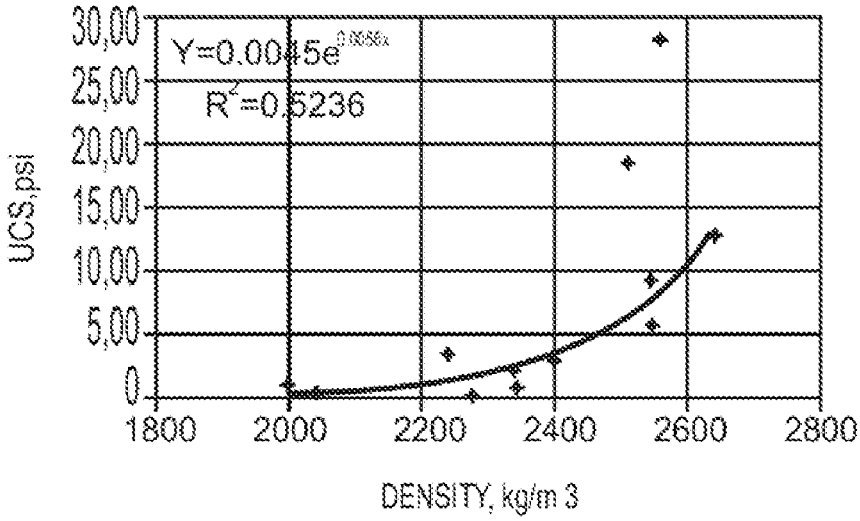
FIGS. 7A-D are graphical diagrams illustrating a methodology of estimating the unconfined compressed strength (UCS)/Strengthening coefficient for 32 Shale from Density, Porosity, P- and S-waves according to an embodiment of the present invention.
Figure 7B:
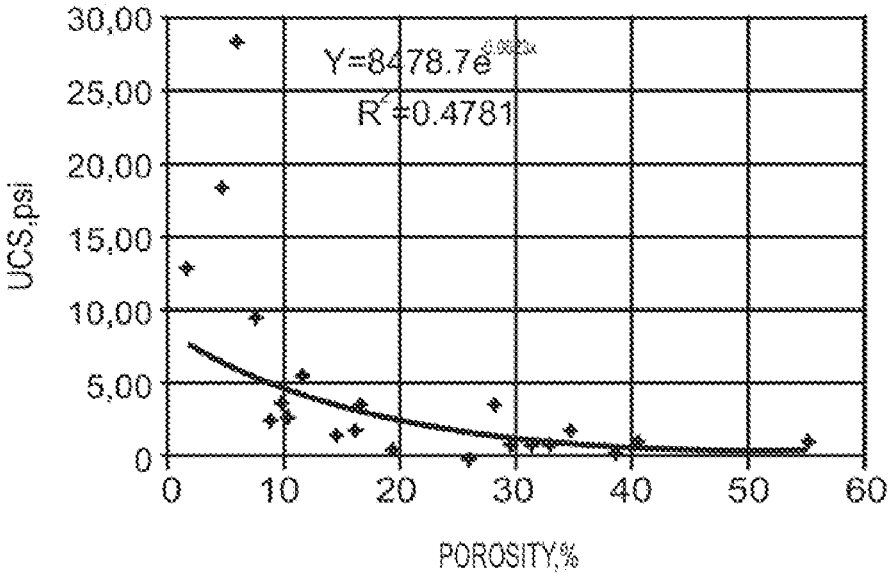
Figure 7C:
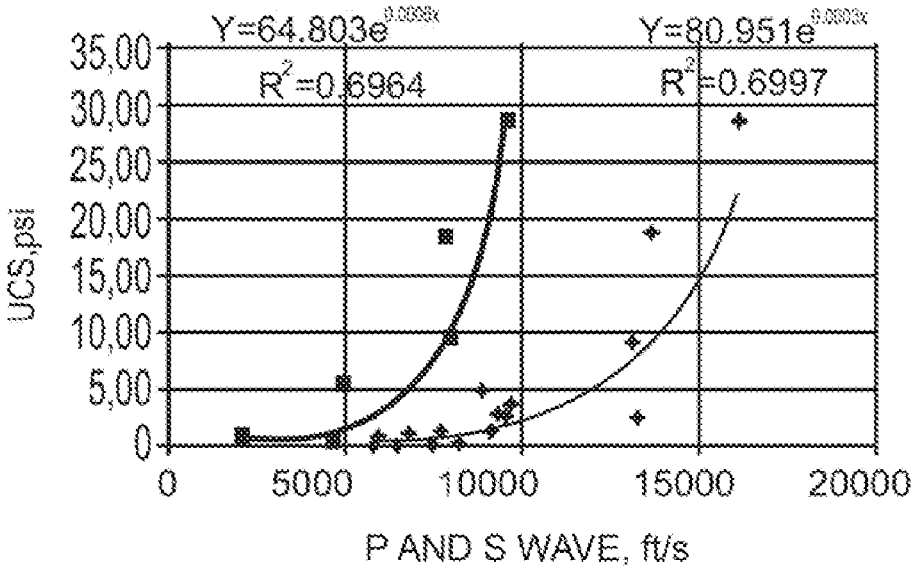
Figure 7D:
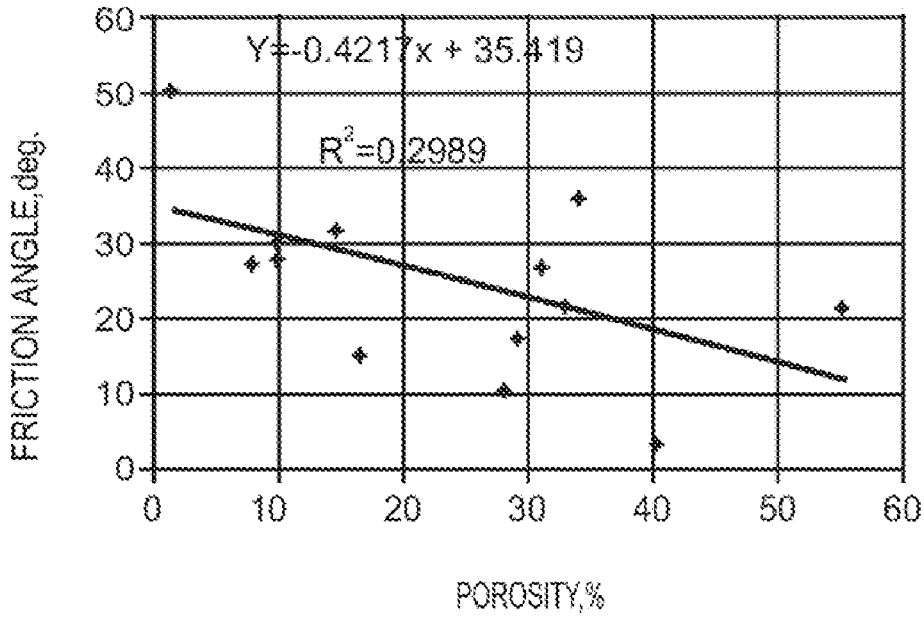
Figure 8A:
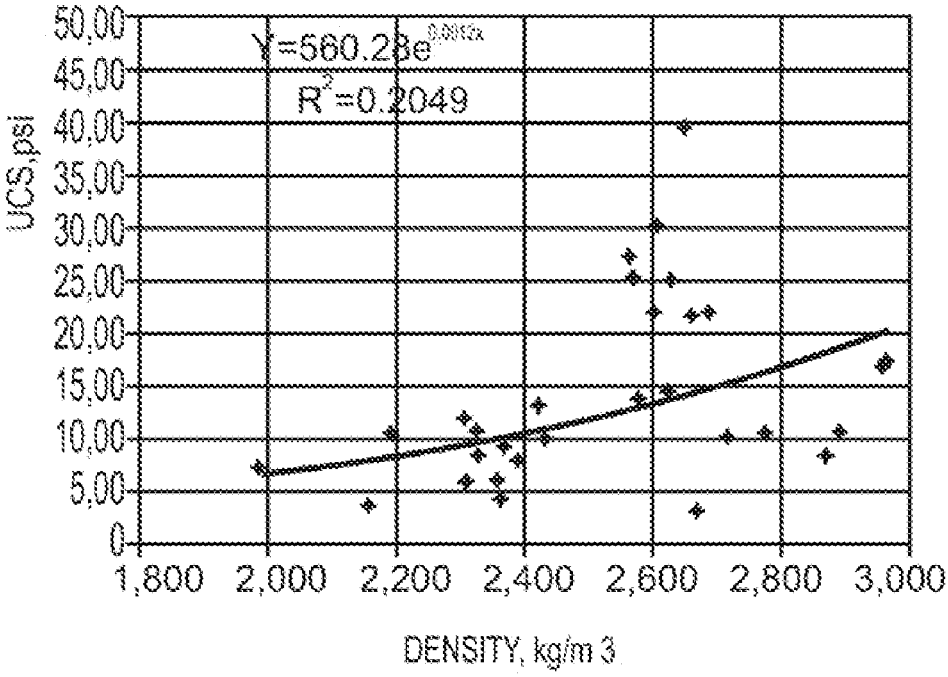
FIGS. 8A-D are graphical diagrams illustrating a methodology of estimating the unconfined compressed strength (UCS)/Strengthening coefficient for 36 Dolomite from Density, Porosity, P- and S-waves according to an embodiment of the present invention.
Figure 8B:
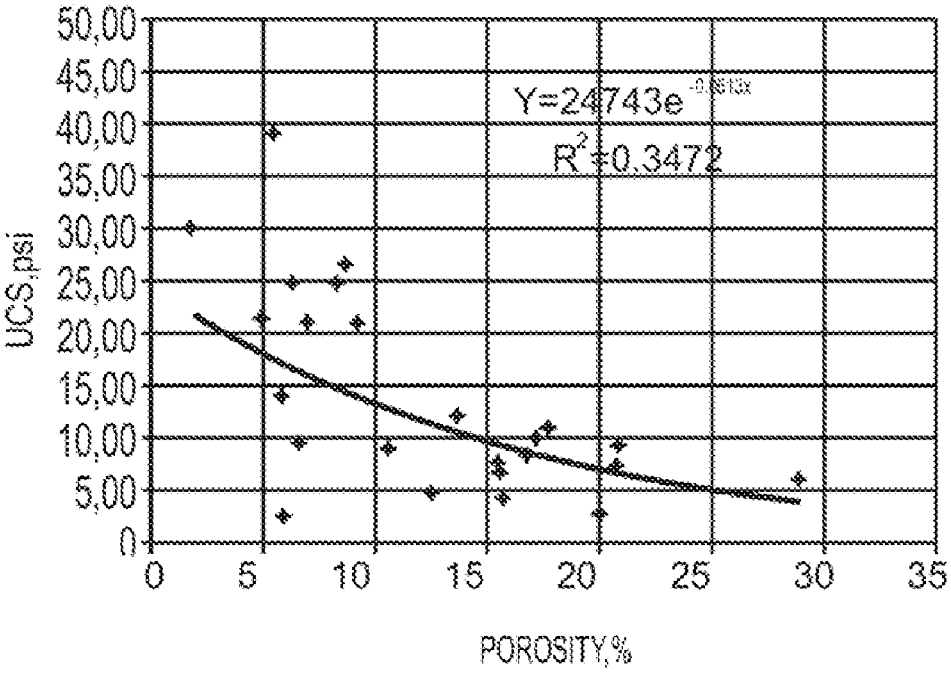
Figure 8C:
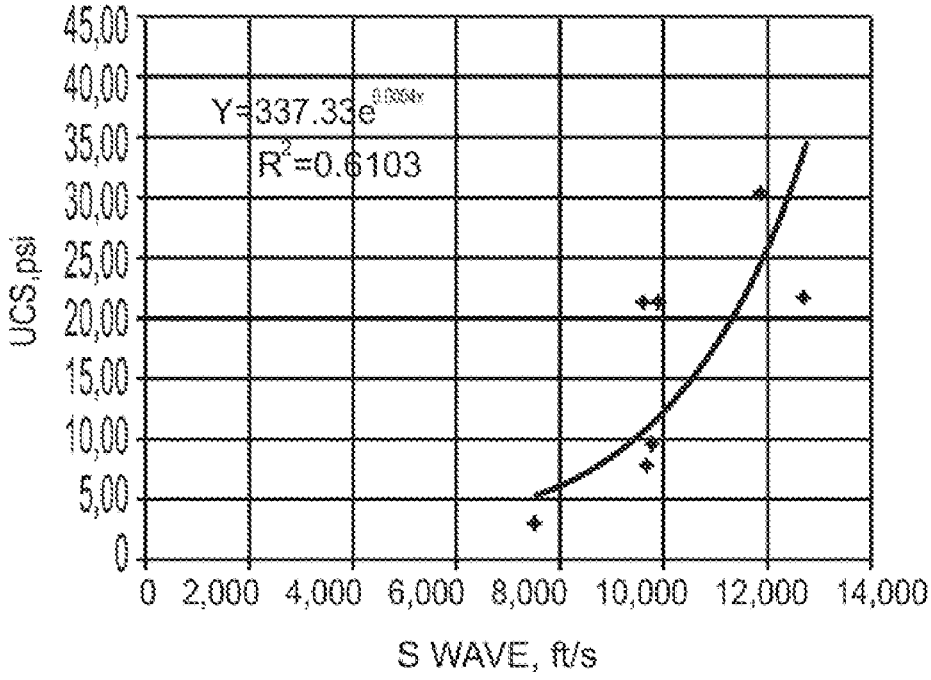
Figure 8D:
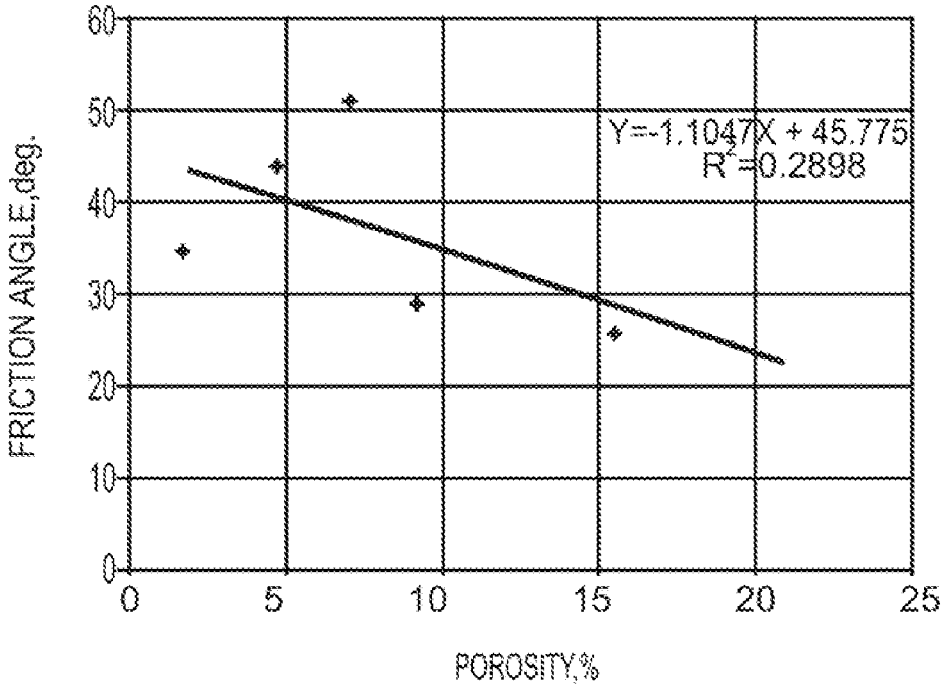

According to embodiments of the present invention, for each component subterranean formation 21-26, these values can be compiled and normalized into a computer model of the properties of the respective subterranean formation 21-26. As illustrated in FIGS. 4A-4F, according to an embodiment of the present invention, an image of the model can be produced as a spider graph, wherein each property is presented on its own axis. This step can also include generating a computer model and spider graph of the formation properties of the target section 20 being the superimposition of the computer models and images of component subterranean formations 21-26, as illustrated in FIG. 4G. This spider graph representation of formation properties can allow for a systematic means of conveying information on numerous properties for easy comparison. Note, a person having ordinary skill in the art will recognize that the illustrated exemplary embodiment is representative of formation properties/factors and are neither a minimal nor exhaustive list of physical, mechanical, and micro-structural properties of a subterranean formation.

Referring again to FIG. 3A, the next step includes computing "drillability" parameters from the formation properties for each of the individual formations 21-26 in the target hole section 20 (block 105) (see, e.g., FIG. 10) Enhanced drillability expressed, for example, as: potential rate of penetration, vibration proneness (vibration tendency), tendency for abrasive wear (abrasiveness), and stickiness or balling potential in the bit type (bit fouling tendency), can be achieved using a specific cutter-metallurgy type, specific cutter-bit design parameters, specific operating parameters including efficient cuttings removal system in the specific drilling environment using specific drill rig type with no change in cutter-bit dullness or balling condition). Drillability parameters can be analyzed to determine the performance characteristics which lead to such design features. The drillability parameters computed or otherwise obtained from the formation properties can include: unconfined (atmospheric) compressive strength (UCS), confined compressive strength (CCS), abrasiveness, bit balling tendency, bottom balling tendency, and vibration tendency.

UCS, strengthening coefficient, and abrasive minerals values can be obtained from the previously calibrated log data as above or lab-core-testing. Required bit-cutter force per unit contact area is proportional to the Mechanical Specific Energy of drilling. The Mechanical Specific Energy is proportional to CCS×Strain-at-Failure. CCS can be calculated from the UCS and a Strengthening coefficient. The UCS and the Strengthening coefficient can be calculated from density, porosity, P and S, as shown, for example, in FIGS. 5A-D, 6A-D, 7A-D and 8A-D, e.g., for sandstone, limestone, shale and dolomites, respectively, individually or collectively. Beneficially, UCS not only indicates atmospheric stress and strain at failure, but is also related with elastic behavior (P & S wave, Young's, bulk and shear modulii) which does not change much under confinement. UCS also indicates the coefficient of energy transfer and extent of vibration in an efficient drilling process. UCS may be used quantitatively, for example, by taking a suitable weighted average of the above-described eight parameters or the area under an eight-dimensional plot (spider plot) of such parameters.

Figure 9:
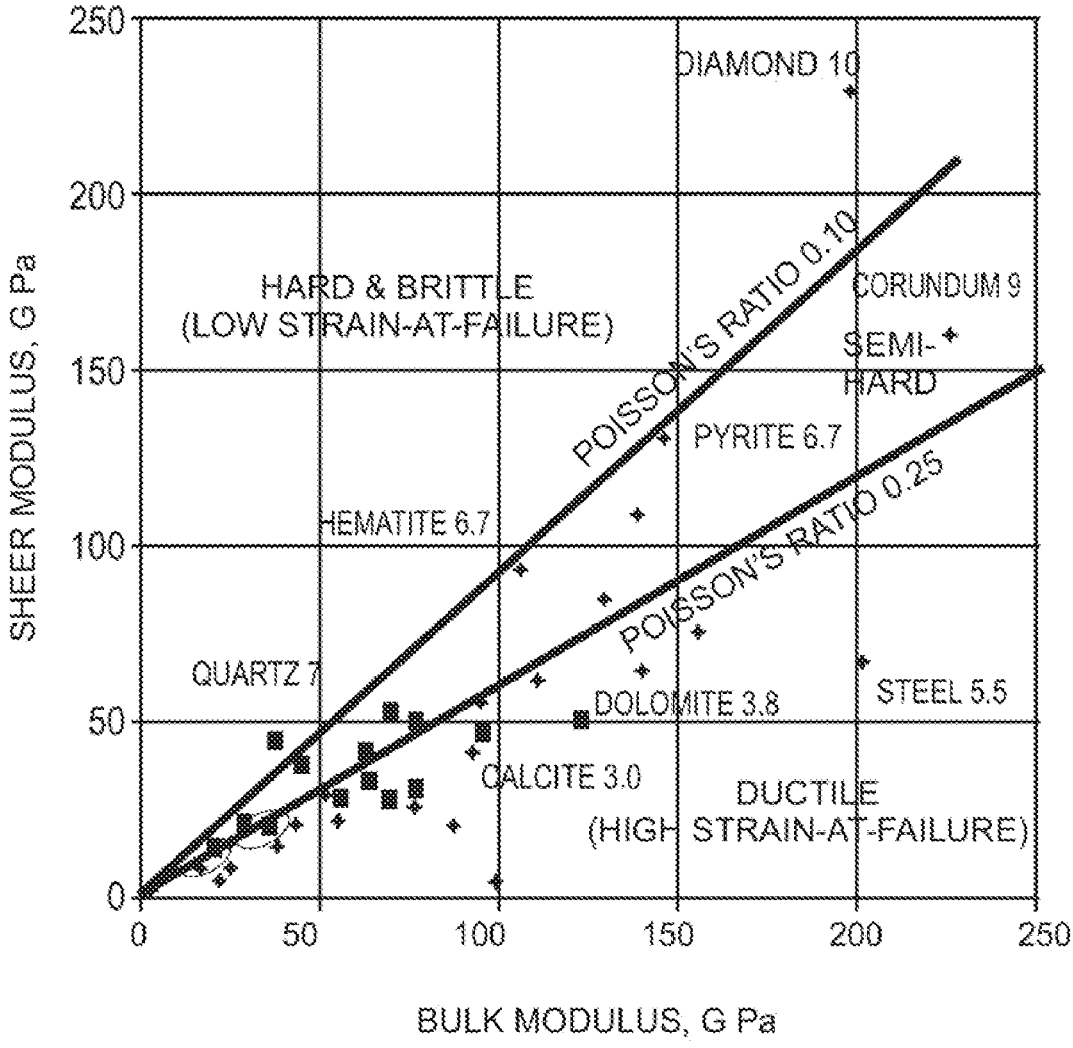
FIG. 9 is a graphical diagram illustrating a methodology of estimating the Strain-at-failure conceptually depicted from log data comprising P- and S-wave data and its calculated Bulk and Shear modulii of elasticity, Poisson's ratio, and Mho's hardness number under brittle, semi-hard, and brittle and ductile conditions according to an embodiment of the present invention.
Figure 10:
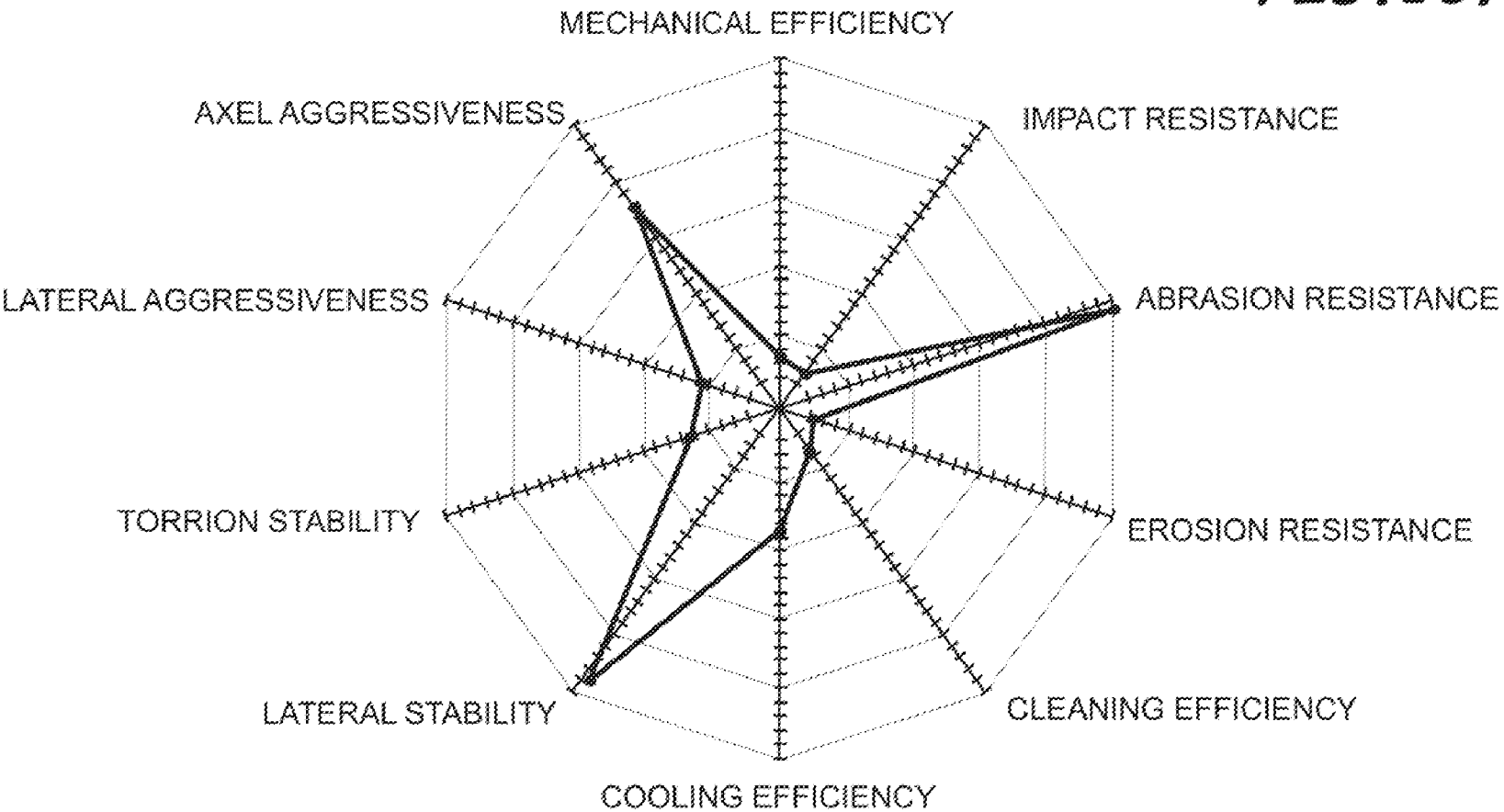
FIG. 10 is a ten-dimensional map or graph displaying target hole section "drillability" parameters or requirements for drilling one of the individual formations of the target hole section of FIG. 2 derived from the formation properties for each separate one of the formations of FIG. 2 according to an embodiment of the present invention.
Figure 11:
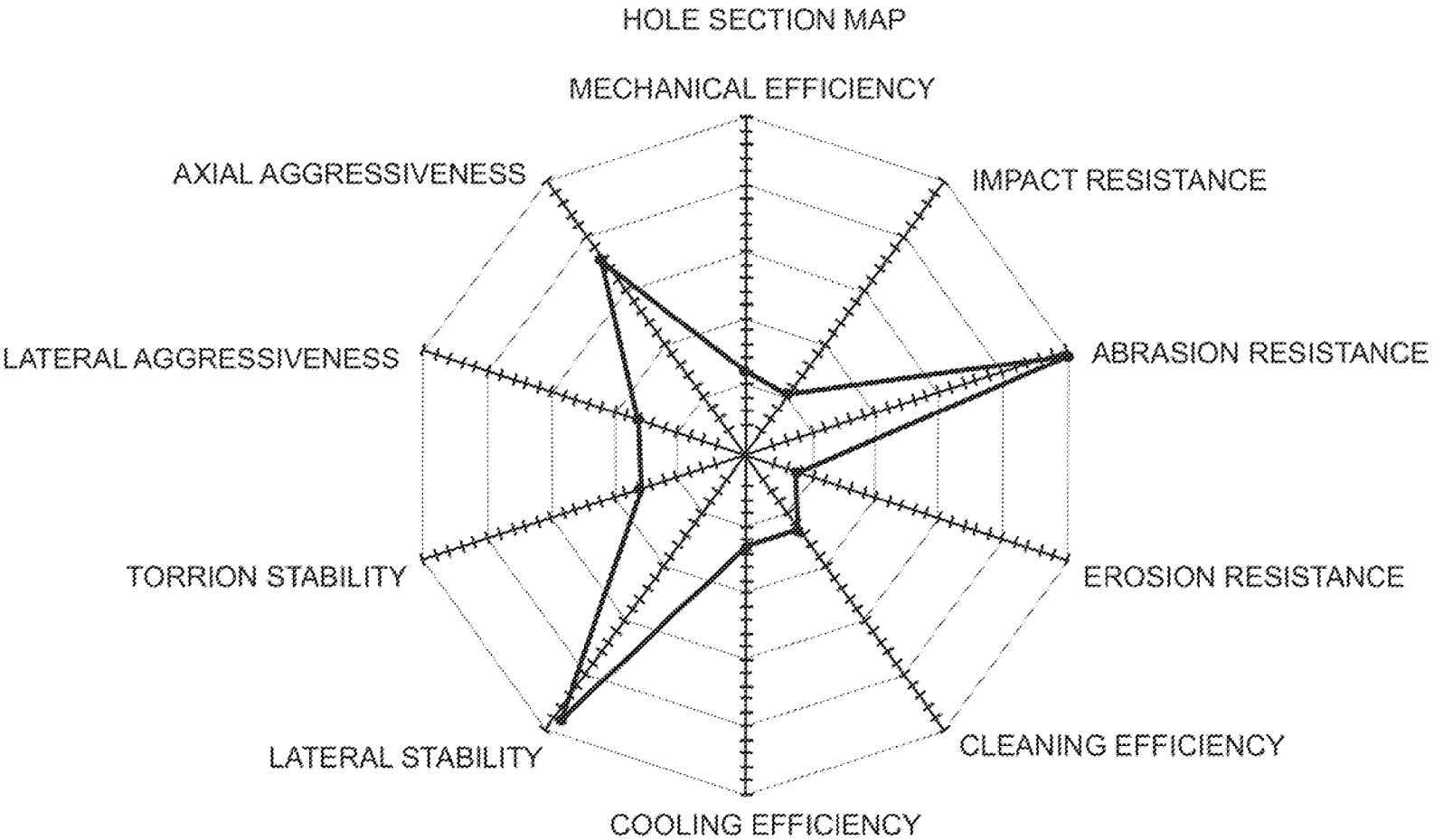
FIG. 11 is a ten-dimensional map or graph displaying collective target hole section "drillability" parameters or requirements collectively for each of the formations of FIG. 2 according to an embodiment of the present invention.
Figure 12:
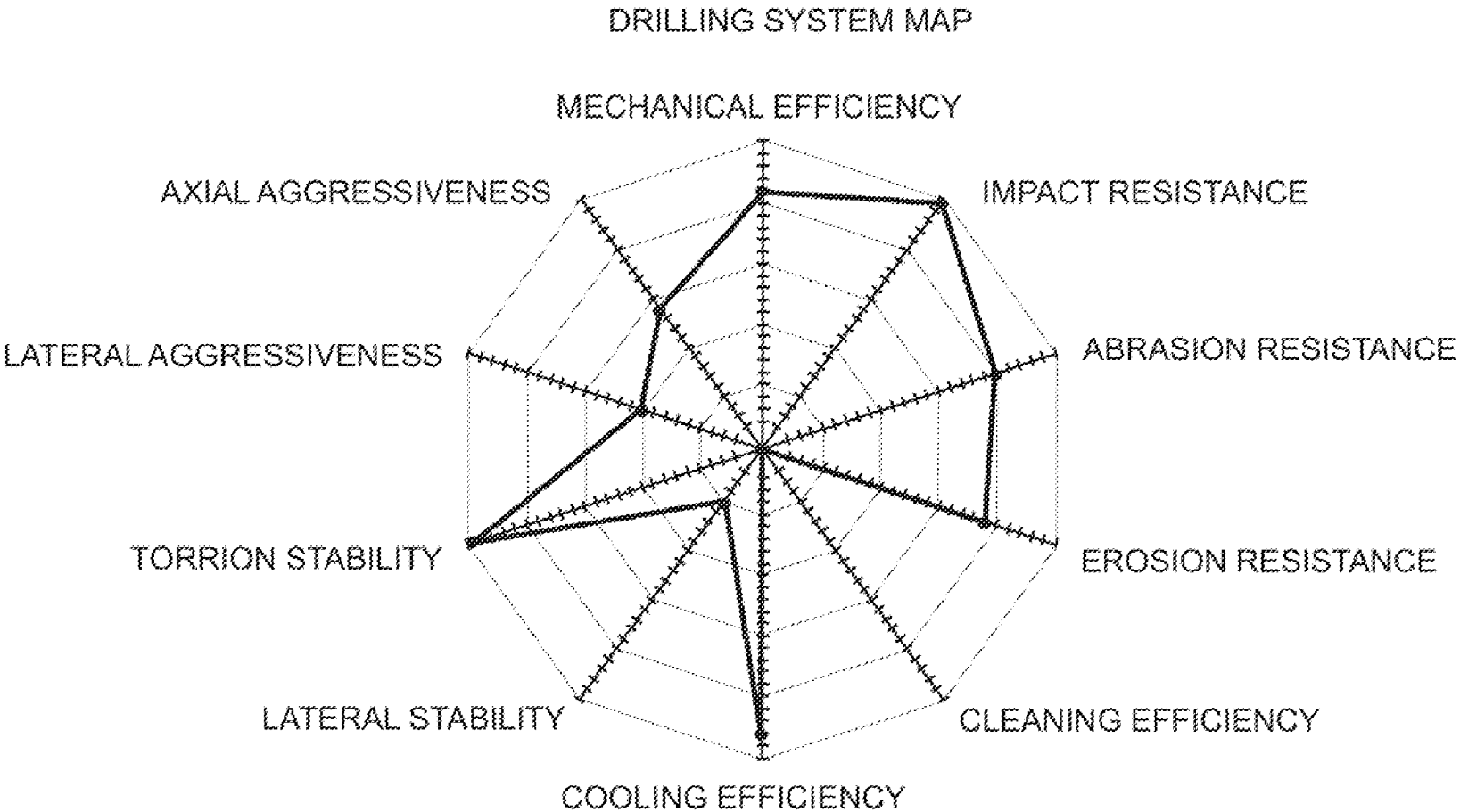
FIG. 12 is a graphical diagram of a ten-dimensional map or graph displaying drilling system performance characteristics of a drilling system for drilling the target hole section of FIG. 2 according to an embodiment of the present invention.
Figure 13:
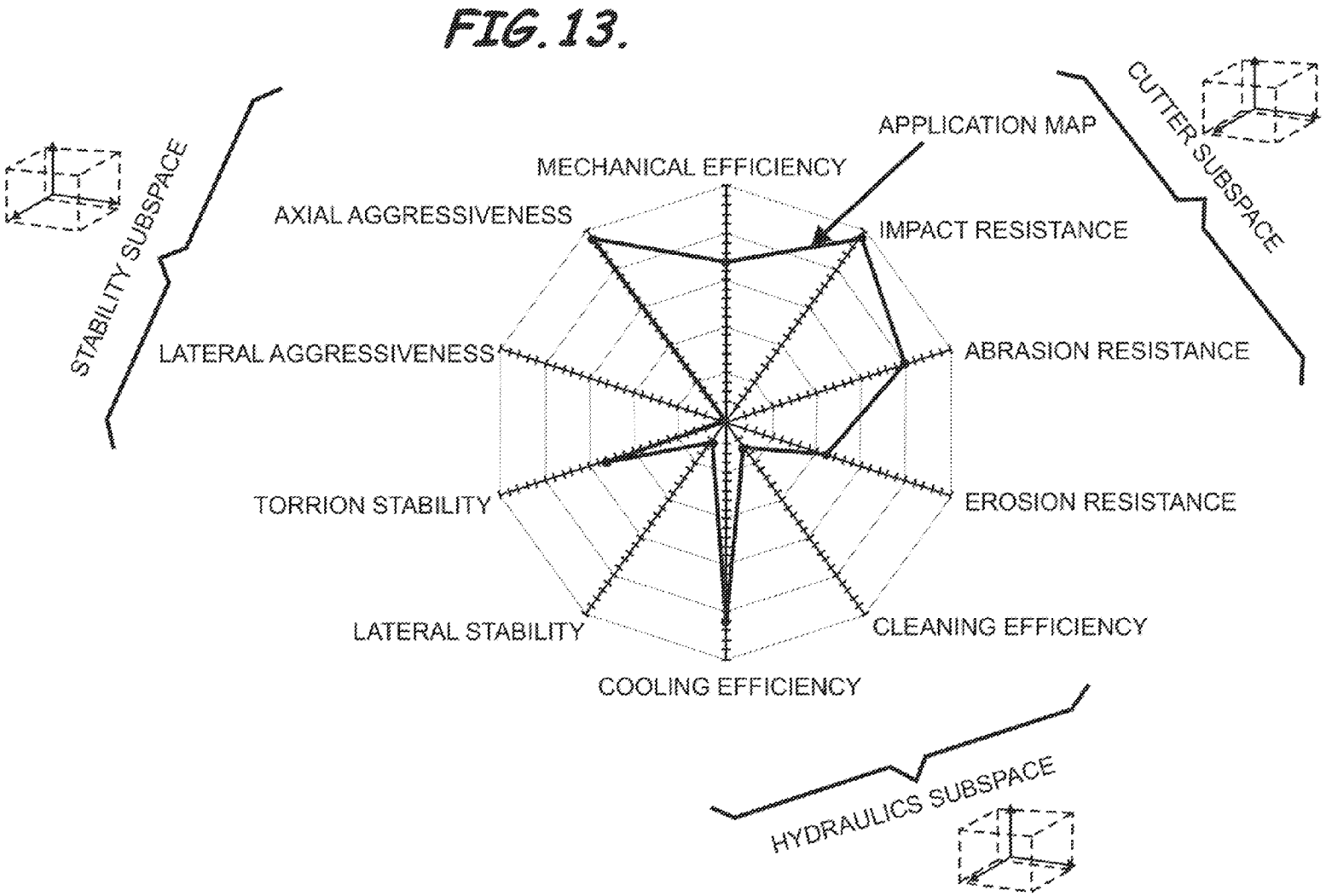
FIG. 13 is a graphical diagram of a ten-dimensional map or graph displaying drilling application performance requirements for drilling the target hole section of FIG. 2 according to an embodiment of the present invention.
Figure 14:
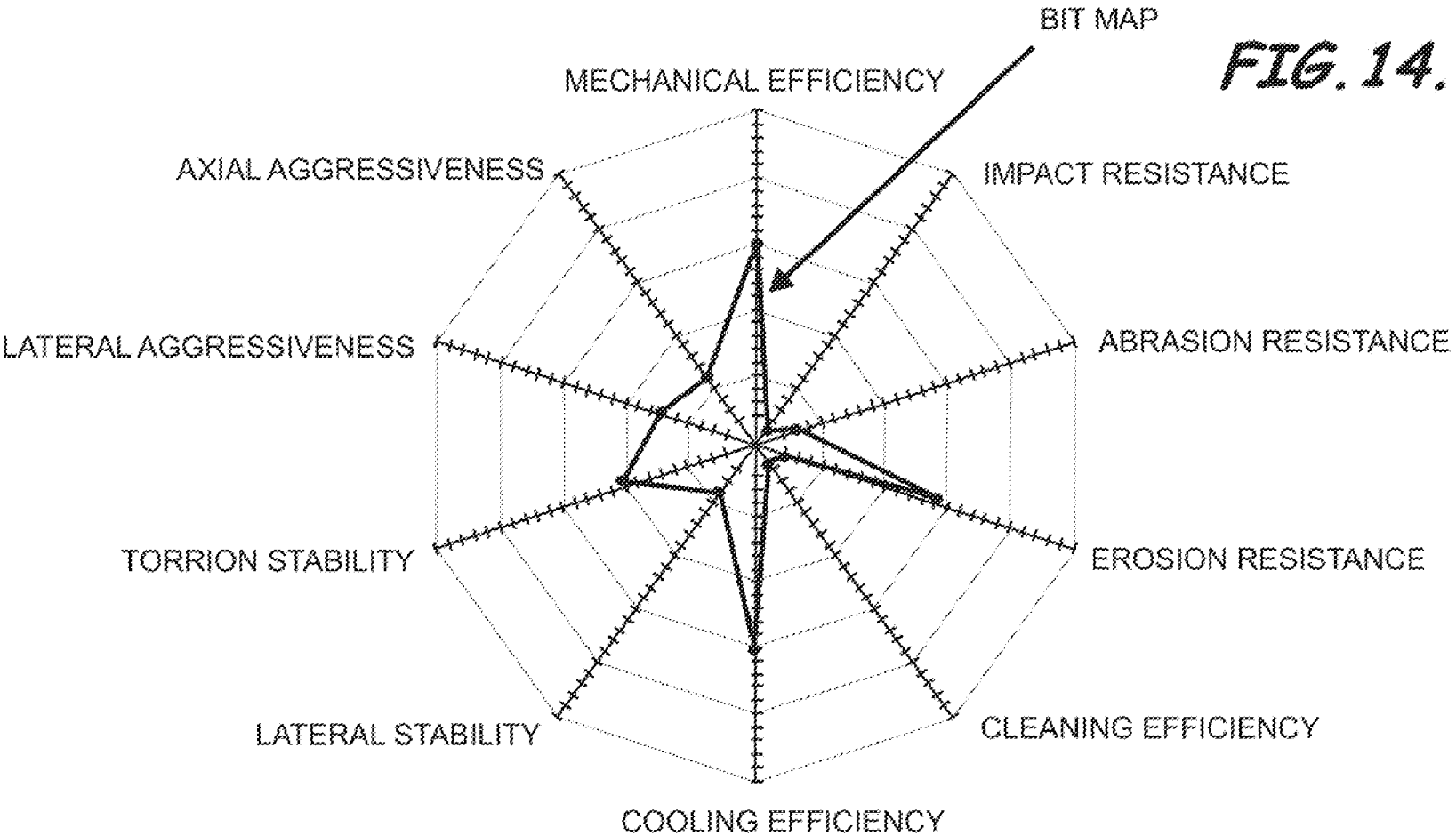
FIG. 14 is a graphical diagram of a ten-dimensional map or graph displaying drilling bit performance characteristics for a drilling bit according to an embodiment of the present invention.

Strain-at-failure can be calculated from borehole pressure environment, porosity, calculated Poisson's ratio and mineralogy. Expected strain at failure, under hard and brittle, semi-brittle and ductile conditions is shown in FIG. 9 in the space of stiffness, Poisson's ratio, mineralogy and Mho's hardness number of scale 1 to 10. Vibration tendency can be linked to acoustic impedance or elastic properties (elastic rebound characteristics on the bit), and a high acoustic impedance or moduli (or low Poisson's ratio) can result in higher rebounding potential in the bit.

The values of the drillability parameters can be based on objectives such as, for example, constraints and requirements of ROP (e.g., aggressiveness, efficiency), durability (e.g., wear, impact, erosion, heat), stability, and stearability, which can depend or be based upon the results of a pre-drill analysis and environmental constraints. The predrill analysis can include the analysis of offset bit records (drilling practice), offset dull characteristics, well prognosis (pore pressure (Pp), drilling fluid desity (MW), hole curvature (DLS), etc.) and equipment (rig, pumps, bottom hole assembly (BHA) design). The environmental constraints can include, for example, rock mechanical properties, rig/pump, hydraulic horsepower per square inch (HSI), flow rate capacity (GPM), in situ stress, operating practices, people, etc.

Referring to FIG. 3A, the next step can include computing a set of drillability parameters of the collective target hole section 20 by combining the computed set of individual formation drillability parameters (block 107), e.g., generating or otherwise forming a single set of combined drillability parameters (see, e.g., FIG. 11) determined by iteratively forming or otherwise determining a set of individual formation drillability parameters (see, e.g., FIG. 10) for each of the formations 21-26, which can be combined to represent the entire hole section 20. The combinations of the individual drillability parameters for each separate formation 21-26 can be constructed in a number of ways, including: a simple summation of the drillability parameter values of each set of drillability parameters across each of the plurality of sets of drillability parameters; summation of corresponding weighted drillability parameter values of each set of drillability parameters across each of the plurality of sets of drillability parameters including application of a weighting scheme based on a thickness of each of the plurality of formations; determining an arithmetic mean of corresponding drillability parameter values of each set of drillability parameters across each of the plurality of sets of drillability parameters; and determining a geometric mean of corresponding drillability parameter values of each set of drillability parameters across each of the plurality of sets of drillability parameters. Alternatively, the collective drilling properties can be represented by the dominant formation, for example, as decided by an optimization engineer.

Still referring to FIG. 3A, a multidimensional performance attribute model and map (see, e.g., FIGS. 10-11) of the target hole section 20 can be generated. Particularly, the method can include determining and storing a performance attribute value for each of a plurality of performance attributes describing target hole section performance requirements of the target hole section 20 for drilling the target hole section 20 (block 109) based upon or otherwise responsive to the individual or combined set of drillability parameters, and generating an associated multidimensional map displaying the relative importance/values of such performance requirements (block 111). The set of target hole section performance requirements can include the various combinations of the following: mechanical efficiency, axial aggressiveness, lateral aggressiveness, lateral stability, torsional stability, cooling efficiency, cleaning efficiency, erosion resistance, abrasion resistance, and impact resistance, defined or otherwise described, according to an embodiment of the present invention, as follows:

Mechanical efficiency represents the desirability of cutting efficiency, which is inversely proportional to specific energy, which in turn is related to compressive strength (UCS or CCS). Thus, mechanical efficiency can be quantified using "combined" UCS or CCS for the hole section. High UCS and/or friction imply strong rock and slow drilling, which in turn implies a greater need for mechanical efficiency. Correspondingly low UCS and/or friction lead suggest a lesser need for mechanical efficiency.

Axial aggressiveness represents the desirability of bits that are axially aggressive, where aggressiveness is defined as the amount of torque generated for a given amount of weight-on-bit. High attribute values would be appropriate for continuous sections of homogenous rock. Interbedded intervals, especially with high interfacial severity (a parameter which can be computed, for example, in the Rocky software) would require lower attribute values. Low UCS and/or friction lead to high axial aggressiveness. Correspondingly high UCS and/or friction lead to low axial aggressiveness.

Lateral aggressiveness represents the desirability of bits that are laterally aggressive, where aggressiveness is defined as the ability to deviate laterally under a given amount of side load. Most hole sections call for low, but non-zero values based on directional response and vibration tendencies. Low UCS and/or friction lead to high lateral aggressiveness. High UCS or friction lead to low lateral aggressiveness. Drilling system considerations are addressed later.

Lateral stability indicates the importance of lateral vibration control. High attribute values would be required for hole sections with significant amounts of hard rock (high acoustic impedance, high modulii of elasticity, lower Poisson's ratio). In such sections, vibrations are more likely, and impact damage is probable. Likewise, high attribute values would be required by hole sections with high interfacial severity. Correspondingly, lower values would be suitable for hole sections where soft rock is prevalent.

Torsional stability, having similar considerations as that of lateral stability, indicates the importance of torsional vibration control. Formations with high acoustic impedance, high modulii of elasticity and lower Poisson's ratio are more prone to vibration, and require bits with greater torsional stability. Further, hole sections at greater measured depth require greater torsional stability due to the increase in drill string compliance, and corresponding proclivity for tosional vibration, with total length.

Cooling efficiency is the ability to dissipate heat associated with rock cutting in the downhole environment. Cutter wear is affected by heat, which in turn is related to cutting efficiency. Target hole sections/formations with high confined compressive strength, and possibly abrasiveness, would demand high attribute values (i.e., demand a higher cooling efficiency). Similarly, hole sections/formations with high shale content (possibly reflected through bit balling and/or bottom balling indices per Rocky algorithms) would require high attribute values for cleaning efficiency. High carbonate content and/or S-wave velocity require high cooling efficiency. Correspondingly, low carbonate and/or S-wave velocity require lesser cooling efficiency. High Mohr-Friction Angle (Ø) and/or low amounts of clay reduce the need for cleaning efficiency. Conversely, low Mohr-Friction Angle and/or high amounts of clay make bit cleaning difficult and require high cleaning efficiency.

Erosion resistance, abrasion resistance, and impact resistance are related to robustness. Hole sections with high sand content, even if formations are not particularly strong, would call for higher erosion and abrasion resistance values. Similarly, hole sections with high values of combined rock strength and abrasiveness would demand high attribute values for both abrasion resistance and impact resistance. Also similarly, hole sections with high significance of lateral and/or torsional vibration would demand high attribute values for impact resistance. High grain size, density, and/or Mohr-Friction Angle (Ø) require high abrasion and erosion resistance. Correspondingly, low grain size, density, and/or Mohr-Friction Angle allow lower abrasion and erosion resistance to be tolerated. High CCS×Mohr-Friction Angle requires high abrasion resistance. Correspondingly, low CCS×Mohr-Friction Angle allows lower abrasion resistance. High acoustic impedance requires high impact resistance. Correspondingly, low acoustic impedance leads to low impact resistance requirements.

Referring to FIG. 3A, a multidimensional performance attribute model and map (see, e.g., FIG. 12) of one or more drilling systems to be used to drill the target hole section 20 can be generated. Particularly, the method can include determining and storing a performance attribute value of each of a plurality of performance attributes describing drilling system performance characteristics associated with a preselected drilling system for drilling the target hole section to thereby define a set of drilling system performance characteristics (block 113) and generating an associated multidimensional map displaying the relative importance/values of such performance requirements (block 115). In alignment with the set of target hole section performance requirements, according to an embodiment of the present invention, the set of drilling system performance characteristics can include various combinations of the following: mechanical efficiency, axial aggressiveness, lateral aggressiveness, lateral stability, torsional stability, cooling efficiency, cleaning efficiency, erosion resistance, abrasion resistance, and impact resistance, described below:

Mechanical efficiency can be considered a neutral attribute for drilling systems.

Axial aggressiveness, on the other hand, would not be neutral. Steerable motor systems would tend to require or favor lower attribute values for toolface control. Some vertical drilling systems would also require or favor lower attribute values, for similar reasons. Rotary steerable systems can tolerate higher attribute values. With respect to lateral aggressiveness, low (but nonzero) values are typically desired for rotary applications to minimize lateral vibration and maintain verticality. Directional intervals requiring low to moderate doglegs would call for similar values as vertical sections. Very low values would be called for when point-the-bit rotary steerable systems are employed. Embodiments of the present invention include algorithms that allow desired side cutting efficiency to be specified given dogleg requirements and bottom hole assembly design.

With respect to lateral stability, most, if not all, systems generally would favor high values, but rotary steerable systems would be expected to require the highest levels of stability to ensure directional control and maximize mean time between failures (MTBF). High speed motors, which tend to lead to low depths of cut, would demand high levels of lateral stability.

With respect to torsional stability, similar to the above, torsional stability becomes more significant when high depths of cut are expected (low speed motors) and at greater depth.

With respect to cooling efficiency, applications where pump pressure and flow rate are limited would require high efficiencies. Similar to the above with respect to cleaning efficiency, applications where pump pressure and flow rate are limited would require high efficiencies.

With respect to erosion resistance, applications where high bit pressure drops are used would require high erosion resistance.

With respect to abrasion resistance, applications where high rotary speeds are expected (medium to high speed motors, turbines) would require high abrasion resistance.

With respect to impact resistance, applications where low depths of cut are expected (high rotary speeds, motor applications) would call for high levels of impact resistance. Applications featuring steerable (i.e. bent housing) motors would call for high values.

Referring to FIG. 3B, a multidimensional performance attribute model and map of drilling application performance requirements (see, e.g., FIG. 13) can be generated. Particularly, the method can include combining the set of target hole section performance requirements (see, e.g., FIG. 10) and the set of drilling system performance characteristics (see, e.g., FIG. 12) (block 117) to determine a performance attribute value for each of a plurality of performance attributes describing performance characteristics of an ideal or optimal drilling bit for drilling the target hole section with the preselected drilling system to thereby define a set of drilling application performance requirements, and generating an associated multidimensional map displaying the relative importance/values of such performance requirements (block 119).

Still referring to FIG. 3B, the method can further include determining and storing a performance attribute value of each of a plurality of performance attributes describing "critical" drilling bit performance characteristics associated with a preselected drilling bit for each of a plurality of candidate drilling bits (block 121) based upon or otherwise responsive to a plurality of adjustable or changeable drilling bit features (e.g., blade count, cutter count, cutter size, gage design (length, geometry), nozzle count, face volume, junk slot area, etc.) to thereby define a plurality of sets of drilling bit performance characteristics each separately associated with one of the candidate drilling bits. The models of the candidate drilling bits and the selectable design features can be stored in database 43 for automated or manual computer user manipulation using input device 41. The method can also include generating a multidimensional drilling bit performance characteristics map ("spider map") of the drilling bit performance characteristics (see, e.g., FIG. 14) for each separate one of the plurality of candidate drilling bits to thereby define a plurality of drilling bit performance characteristics maps (block 123) available for selection (e.g., pre-stored in database 43). Accordingly, the method can further include assembling a library of virtual computer models of candidate drilling bits including the drilling bit performance characteristics for a suite of drilling bit designs, for example, in database 43.

In alignment with the set of target hole section performance requirements (see, e.g., FIG. 14), according to an embodiment of the present invention, the set of drilling bit performance characteristics can include various combinations of the following: mechanical efficiency, axial aggressiveness, lateral aggressiveness, lateral stability, torsional stability, cooling efficiency, cleaning efficiency, erosion resistance, abrasion resistance, and impact resistance, described below:

Mechanical efficiency can be measured or computed, for example, from calibrated models based on the Mechanical Specific Energy (MSE) required to drill a given rock at a given depth of cut. The baseline conditions can vary. For illustrative purposes, the baseline conditions can be Carthage limestone, 3 kpsi confinement (or atmospheric), 120 RPM, 30 ft/hr. In this example, the depth of cut would equal 0.050 in. per revolution, (e.g., depth of cut=0.2*30/120=0.050 inch/revolution). The evaluation methods can include, for example, use of a high pressure simulator, single point cutter test, or surface rig.

Axial aggressiveness can be measured or computed, for example, as the bit specific friction coefficient while drilling a given rock at a given depth of cut (e.g. same conditions as above). Lateral aggressiveness can be measured or computed, for example, as the lateral rate of penetration using a given side load and rotary speed in a given rock (e.g. Carthage limestone with 1,000 lb side load at 120 RPM). Evaluation methods can include, for example, use of a surface rig, or computer models as described in "Dynamics Modeling of PDC Bits," SPE/IADC 29401, H. Hanson and W. Hansen.

Lateral stability can be measured or computed, for example, as "Whirl Traction" or "μ Variation" (coefficient of variation of the axial aggressiveness) in a given rock at a given depth of cut, e.g., Carthage limestone at 0.050 in/rev, as above. Evaluation methods can include, for example, use of a surface rig or the software described in SPE/IADC 29401.

Torsional stability can be measured or computed, for example, as a function of the change in aggressiveness at two depths of cut (0.010 versus 0.050 in/rev), or alternately the change in torque with weight-on-bit held constant at two different rotary speeds in a given rock, e.g., 30 RPM versus 180 RPM with 10,000 lb of weight-on-bit in Carthage limestone. Evaluation methods can include, for example, use of a surface rig or the above referenced software.

Cooling efficiency can be measured or computed, for example, as a function of the maximum cutter temperature on the bit profile at 30% wear under reference conditions (e.g., 50 gal/min per inch of bit diameter, nozzle area required to generate four hydraulic horsepower per square inch). Alternately, the temperature adjacent to a reference cutter (e.g., the last cutter on the profile) under these conditions can be used as a measure. Evaluation methods can include, for example, use of computational fluid dynamics (CFD) software such as FLUENT or bit performance prediction software (e.g. PDC Wear).

Cleaning efficiency can be measured or computed, for example, as the rate of penetration (ROP) at which balling occurs tinder baseline conditions, the percentage of particles that escape the bit face in a fixed amount of time, or the minimum "Pinch Point Ratio" (cross sectional area of flow versus volume of cuttings passing through) along the profile computed using CAD and PDC Wear software. Evaluation methods can include, for example, use of a high pressure simulator, flow visualization experiments, CFD software, and/or PDC Wear software.

Erosion resistance can be measured or computed, for example, as a function of maximum fluid velocity adjacent to any cutter on the profile of the bit under reference conditions, e.g., 50 gal/min per inch of bit diameter, and nozzle area required to generate four hydraulic horsepower per square inch. Evaluation methods can include, for example, use of CFD software.

Abrasion resistance can be measured or computed, for example, as a function of the combined result of cutter properties and bit design (i.e. number of cutters). Cutter properties can be quantified (evaluated), for example, via measuring the volume of reference rock (e.g. Sierra White granite) machined on a vertical boring mill versus volume of diamond table removed at a given number of round trips (e.g. 150) at a given depth of cut (e.g. 0.010 in). Bit design effects can be quantified using software such as the PDC Wear program as predicted footage drilled at a specified weight-on-bit in a specified rock at a specified rotary speed, at which point a minimum rate of penetration is reached (e.g. 10 ft/hr).

Impact resistance can be measured or computed as a function of both cutter properties and bit design. High cutter counts, high stability levels, and impact resistant cutters would yield high values. Cutter toughness can be quantified, for example, by measuring the total impact energy required to cause cutter spalling/fracture in drop impact tests.

Note, as with the target hole section performance requirements and the drilling system performance characteristics, a person having ordinary skill in the art will recognize that the list of exemplary characteristics/requirements (e.g., drilling bit performance characteristics) are representative and are neither a minimal nor exhaustive list.

Referring again to FIG. 3B, the method can further include performing a multi-objective optimization between the set of drilling application performance requirements and each set of drilling bit performance characteristics of the candidate drilling bits (block 125) to identify one or more of the plurality of candidate drilling bits having a substantial alignment between the set of drilling application performance requirements and the respective set of drilling bit performance characteristics, and providing/displaying on user display 39 a rank ordered list of candidate drilling bits responsive to performing the multi-objective optimization (block 127). Beneficially, the optimization algorithm of the program product 51 can evaluate each candidate drilling bit, separately assign an overall value representing the level of alignment between the drilling application performance requirements and the drilling bit performance characteristics of the candidate drilling bits, and order the results, without need for manual iteration by the user.

Referring to FIG. 3C, the method can further include generating a combined multidimensional map (see, e.g., FIG. 15) graphically presenting the multidimensional drilling application performance requirements map (see, e.g., FIG. 13) of the drilling application performance requirements overlaid with at least one of a plurality of multidimensional drilling bit performance characteristics maps (see, e.g., FIG. 14) of the drilling bit performance characteristics (block 129) to thereby provide a multidimensional visual comparison between the drilling application performance requirements and drilling bit performance characteristics for at least one of the plurality of candidate drilling bits. Beneficially, as will be described in more detail below, such combined multidimensional map (FIG. 15) can allow a user/manager to select a closest matching drilling bit (block 131) from a suite of drilling bit designs (e.g., suite of candidate drilling bits stored in database 43) that can be used to optimize the critical drilling bit performance characteristics identified for the target subterranean formation, or to evaluate how close a selected candidate bit or bits selected by the computer 31 from the suite of designs satisfy the anticipated performance requirements. While the spider graphs provide easy comparisons with the human eye, the method allows standard optimization techniques to determine the drilling bit design from the library of designs that best satisfies the critical drilling bit performance characteristics.

Figure 15:
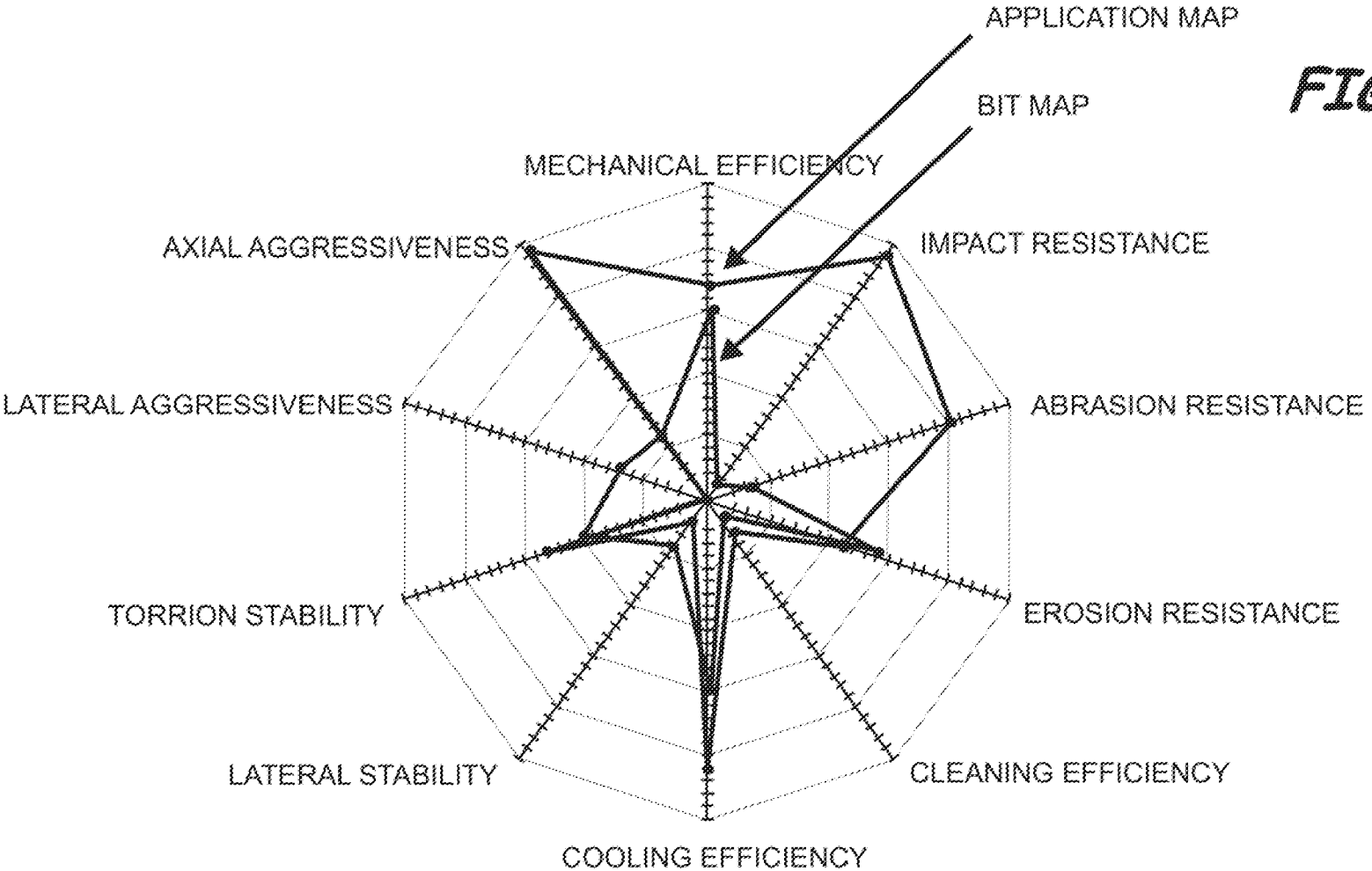
FIG. 15 is a graphical diagram of a ten-dimensional map or graph displaying the drilling bit performance characteristics for a drilling bit illustrated in FIG. 14 overlaid upon the drilling application performance requirements for drilling the target hole section of FIG. 2 illustrated in FIG. 13 according to an embodiment of the present invention.

The optimization/selection process can be based upon selecting candidate drilling bits which maximize an alignment between the identified drilling application performance requirements and the drilling bit performance characteristics of each candidate drilling bit. Note, FIG. 15 illustrates an example of an extremely poor alignment. The alignment can be quantified according to a number of methodologies known to those skilled in the art. For example, the alignment can be quantified graphically using the intersection or amount of overlap of the areas represented by the drilling bit performance characteristics and the drilling application performance requirements. Also for example, vector math can be utilized. The maps (e.g., spider plots) can be considered multidimensional (e.g., 10 dimensional) vectors with the bit vector $\bar{b}=b_i\hat{n}_i$ and the application vector $\bar{a}=a_i\hat{n}_i$, where i=10. The scalar (dot) product is given by:

$$\bar{a}\cdot\bar{b}=a_ib_i=a_1b_1+a_2b_2+\ldots a_{10}b_{10}.$$

The higher the sum of the products of the various dimensional values, the better the quality of the match between bit and application. Further, according to various other schemes, one or more of the vectors (dimensions) are weighted. Using this approach, a quick series of computations can be accomplished such that the drilling application performance requirements/map is compared to every bit in the size of interest with predefined drilling bit performance characteristics/maps, and those that match the best could be identified and ranked, as described above. Beneficially, this can be accomplished manually by the user responsive to viewing the drilling bit performance characteristics maps in comparison with the drilling application performance requirements map, or automatically by computer 31 as part of the optimization process. Further, if no suitable match is found, the drilling application performance requirements/map can be used as the basis for specifying drilling bit performance characteristics in a new design. That is, if the readymade "out of box" bit having sufficiently matching features is available, the bit is generally selected. Otherwise, a custom design can be created by a design engineer or design team using analytical, numerical and experimental techniques including cost benefit analysis.

Accordingly, as perhaps best shown in FIG. 3C, according to an embodiment of the present invention, a method of selecting a drilling bit for drilling an identified target hole section 20 can include or further include the steps of generating and storing at least one but preferably a plurality of virtual drilling bit models each having a plurality of adjustable virtual drilling bit features (block 133) responsive to a virtual library including the plurality of adjustable virtual drilling bit features stored, for example, in database 43 and accessible to computer 31 and drilling bit selection and optimization program product 51, to thereby form a suite of drilling bit designs that can be used to optimize the critical drilling bit performance characteristics identified for the target subterranean formation. The adjustable drilling bit feature can include a plurality of selectable virtual versions having a different size, shape, or quantity selectable within a continuum of values. For example, a drop-down menu or other graphical interface known to those skilled in the computer systems art can allow a virtual selection of the blade count, cutter count, cutter size, gage design (length, geometry), nozzle count, face volume, and/or junk slot area, from a range of values. Alternatively, direct on-screen graphical manipulation, i.e., drag and drop, sizing, etc., can be provided. This beneficially can allow a user, preferably using at least initial design parameters supplied by the designer or design team, to propose modifications to an existing drilling bit design for one or more identified candidates, or initiate a design, e.g., from scratch, to better satisfy the computer model and spider graph of the critical drilling bit performance characteristics.

The method can also include performing a multi-objective optimization between the set of drilling application performance requirements and each of the plurality of adjustable virtual drilling bit features (block 135) to thereby determine feature attributes of the plurality of drilling bit features that when combined to form a candidate virtual drilling bit (see, e.g., FIG. 17) provide the candidate virtual drilling bit with drilling bit performance characteristics substantially coinciding with the determined drilling application performance requirements to thereby provide/form a virtual design for an optimal drilling bit defining a candidate optimal drilling bit for drilling the target hole section 20. Beneficially, the optimization engine of the program product 51 can allow automated iterations to be performed so that the discrete changes to the feature attributes can be processed within an inner loop of the algorithm. According to an embodiment of the program product 51, the optimization engine can evaluate each candidate drilling bit with each iterative change to one or more of the feature attributes, separately assign an overall value representing the level of alignment between the drilling application performance requirements and the drilling bit performance characteristics of the bit under evaluation, and order the results, without need for manual iteration by the user. Such changes can be discrete such as, for example, a change in blade count or cutter count, or selected within a continuum such as, for example, cutter size, gage length, gage geometry, nozzle count, face volume, or junk slot area, etc. According to another embodiment of the optimization engine, various algorithms such as the gradient ascent and/or gradient descend algorithms can be used to enhance temporal efficiency. Various other or alternative optimization engines or methodologies, as known to those skilled in the art, can be applied to or within the program product 51 to allow efficient optimization, and thus, efficient and accurate selection of an optimal drilling bit design for the determined drilling application performance requirements.

In order to evaluate the candidate virtual design (FIG. 17), the method can further include determining the drilling bit performance characteristics of the candidate optimal drilling bit (block 137), and generating a multidimensional map (see, e.g., FIG. 15) including a drilling application performance requirements map of the drilling application performance requirements (see, e.g., FIG. 13) overlaid with a drilling bit performance characteristics map (see, e.g., FIG. 14) of the drilling bit performance characteristics of the candidate optimal drilling bit (block 139) to thereby provide a multidimensional visual comparison between the drilling application performance requirements and drilling bit performance characteristics for the candidate optimal drilling bit.

Figure 16:
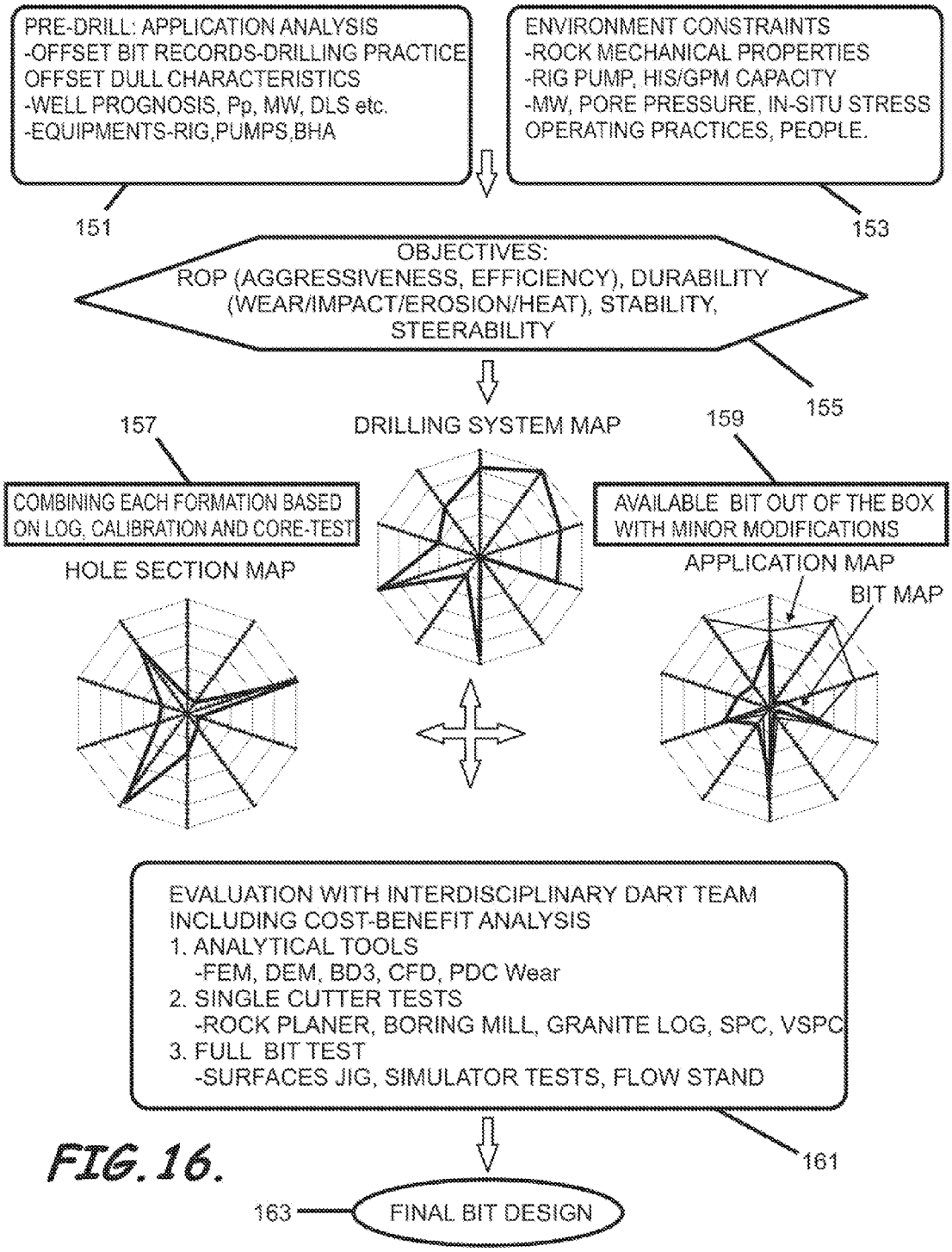
FIG. 16 is a schematic flow diagram summarizing a method to select or optimize a drilling bit for drilling an identified target hole section of earth according to an embodiment of the present invention.
Figure 17:
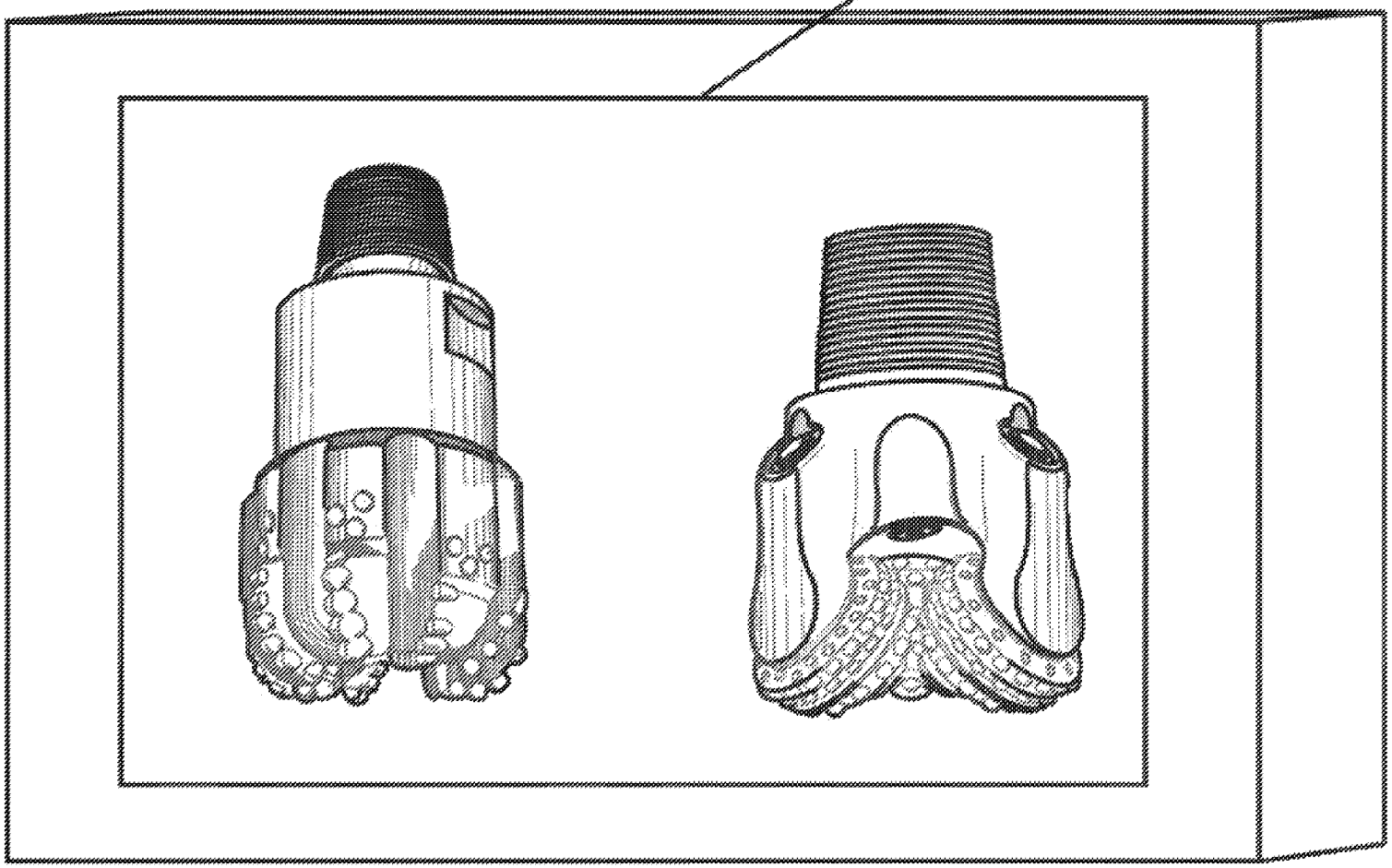
FIG. 17 is a schematic diagram of a graphical user interface for designing and optimizing a virtual candidate drilling bit according to an embodiment of the present invention.

FIG. 16 provides a high level flow diagram which visually summarizes portions of the above steps/operations of FIGS. 3A-C, according to an embodiment of the present invention, to include conducting a drilling-drill application analysis (block 151) along with a review of environmental constraints (block 153) in order to formulate objectives (block 155). The diagram further illustrates combining each formation section based on log, calibration, and/or core-tests (block 157), and analyzing the combination of a hole section map in conjunction with a drilling system that in conjunction with an available bit, e.g., with minor modifications (block 159) to determine the availability of an "off-the-shelf" bit. The diagram further illustrates evaluating the selection, for example, using an interdisciplinary team (block 161) which can include the use of analytical tools (e.g., FEM, DEM, BD3, CFD, PDC Wear, etc.), single cutter tests (e.g., rock planer, boring mill, granite log, SPC, VSPC, etc.) and full bit tests (e.g., surface rig, simulator tests, flow stand, etc.) in order to determine the final bit design (block 163).

According to another embodiment of a method of, or program product for, selecting a drilling bit for drilling an identified target hole section 20 of earth, rather than generating a multidimensional map displaying the relative importance/values of the target hole section performance requirements, generating a multidimensional map displaying the relative importance/values of the drilling system performance characteristics, generating a multidimensional map displaying the relative importance/values of the drilling application performance requirements, and/or generating a multidimensional map displaying the relative importance/values of the drilling bit characteristics for each candidate drilling bit, the user is provided the end product: one or more of the various multidimensional maps. In such embodiments of the present invention, pattern recognition technology (e.g., software), known to those skilled in the art, can be used to extract the base data contained within the map or maps, and/or to directly perform the bit selection through graphical acquisition and comparison of the predefined multidimensional maps. For example, given the drilling application performance requirements multidimensional map and a plurality of drilling bit performance characteristics maps, the pattern recognition software can be utilized to return an identification of a candidate drilling bit having the closest match between the associated drilling bit performance characteristics and the drilling application performance requirements. Other such variations are, of course, within the scope of the present invention.

It is important to note that while the foregoing embodiments of the present invention have been described in the context of a fully functional system and process, those skilled in the art will appreciate that the mechanism of at least portions of the present invention and/or aspects thereof are capable of being distributed in the form of a computer readable medium in a variety of forms storing a set of instructions for execution on a processor, processors, or the like, and that embodiments of the present invention apply equally regardless of the particular type of signal bearing media used to actually carry out the distribution. Examples of computer readable media include, but are not limited to: nonvolatile, hard-coded type media such as read only memories (ROMs), CD-ROMs, and DVD-ROMs, or erasable, electrically programmable read only memories (EEPROMs), recordable type media such as floppy disks, hard disk drives, CD-R/RWs, DVD-RAMs, DVD-R/RWs, DVD+R/RWs, HD-DVDs, memory sticks, mini disks, laser disks, Blu-ray disks, flash drives, and other newer types of memories, and certain types of transmission type media such as, for example, digital and analog communication links capable of storing the set of instructions. Such media can contain, for example, both operating instructions and operations instructions described with respect to program product 51, the program products 51, itself, and the computer executable portions of the method steps according to the various embodiments of the present invention related to selecting or optimizing a drill/drilling bit for drilling an identified target hole section of earth, described above.

The various embodiments of the present invention have several advantages. For example, the system, program product, and methods of the present invention, described herein, advantageously provide for an efficient and systematic way to capture and compare performance characteristics for drilling bits to facilitate bit design optimization and selection. Furthermore, the embodiments of the present invention conveniently provide a novel, efficient and systematic way to express the drillability of a rock in terms of its physical, mechanical, and micro-structural properties. Embodiments of the present invention advantageously employ multiple measured parameters, some of which could be considered redundant, to characterize, in a quantitative sense, a given rock, along with application of a similar approach to characterize, in a quantitative sense, a given drilling bit design (and drilling application), which when used together, can provide a means for selecting suitable, or alternatively optimal, bits for a given application. For example, where Folk (1959) and Dunham (1962), and its progeny (which have enhanced and clarified the two classification systems with more details of grain sizes, pore systems and porosity), still only provide such data in a qualitative way, various embodiments of the present invention, in contrast, characterize various rock formations (e.g., carbonate rocks) in terms of its porosity, density, compressional sonic (P wave or Dtc slowness), and shear sonic (S wave or Dts slowness), grain or block sizes and mineralogy data for estimating UCS and friction angle which together indicates the in-situ strength. These rock properties can be readily obtained either from core samples obtained from borehole, or captured while logging. Further, if there is prior calibration work, the drillability can be inferred directly. Further, these eight rock properties are simple enough to understand and use in the drilling industry, but detailed enough to describe drillability to a great extent. Embodiments of the present invention advantageously assign values to a set of dimensions that define a "design and application space," where each of these dimensions is a quantifiable performance attribute; quantify both drilling bits and hole sections, preferably considering drilling systems and well profiles, in terms of these dimensions/attributes; and seeks and finds a drilling bit that has characteristics that map as closely as possible to the application requirements (either an existing drilling bit, or feature sets that are desirable in a new design). Further, embodiments of the present invention provide for selection and optimization of a complete array of types of drilling bits including the polycrystalline diamond compact (PDC) drilling bit, and the roller cone drilling bit.

This application is related to U.S. Provisional Patent Application No. 61/080,594, filed Jul. 14, 2008, and is related to PCT Patent Application No. PCT/US09/50479, filed Jul. 14, 2009, each incorporated herein by reference in its entirety.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification.

That claimed is:

1. A computer-assisted method of selecting and optimizing a drilling bit for drilling an identified target hole section of earth containing at least one formation, the method comprising the steps of:

determining a formation property value for each member of a set of a plurality of formation properties for each formation forming the target hole section to thereby define at least one set of formation properties;

determining a drillability parameter value of each member of a set of individual formation drillability parameters for each separate one of the plutality of formations forming the target hole section responsive to the plurality of sets of formation properties to thereby define a plurality of sets of individual formation drillability parameters;

combining each of the plurality of sets of individual formation drillability parameters to thereby represent the target hole section with a set of combined drillability parameters;

determining a performance attribute value for each of a plurality of performance attributes describing target hole section performance requirements of the target hole section for drilling the target hole section responsive to the set of combined drillability parameters to thereby define a set of target hole section performance requirements;

determining a performance attribute value of each of a plurality of performance attributes describing drilling system performance characteristics associated with a preselected drilling system for drilling the target hole section to thereby define a set of drilling system performance characteristics;

combining the set of target hole section performance requirements and the set of drilling system performance characteristics;

responsive to the step of combining the set of target hole section performance requirements and the set of drilling system performance characteristics, determining a performance attribute value for each of a plurality of performance attributes describing performance characteristics of an optimal drilling bit for drilling the target hole section with the preselected drilling system to thereby define a set of drilling application performance requirements;

providing a rank ordered list of candidate drilling bits responsive to performing the multi-objective optimization; and generating a multidimensional map comprising a drilling application performance requirements map of the drilling application performance requirements overlaid with at least one of a plurality of drilling bit performance characterisitics maps of the drilling bit performance characteristics to thereby provide a multidimensional visual comparison between the drilling application performance requirements and drilling bit performance characterisitics for at least one of the plurality of candidate drilling bits.

2. A method as defined in claim 1, further comprising the steps of:

determining a performance attribute value of each of a plurality of performance attributes describing drilling bit performance characteristics associated with a preselected drilling bit for each of a plurality of candidate drilling bits responsive to a plurality of drilling bit features to thereby define a plurality of sets of drilling bit performance characteristics; and performing a multi-objective optimization between the set of drilling application performance requirements and each set of drilling bit performance characteristics to identify one or more of the plurality of candidate drilling bits having a substantial alignment between the set of drilling application performance requirements and the respective set of drilling bit performance characteristics to thereby select a best match drilling bit for drilling the target hole section.

3. A method as defined in claim 1, further comprising the steps of:

generating at least one virtual drilling bit model having a plurality of adjustable virtual drilling bit features responsive to a virtual library including the plurality of adjustable virtual drilling bit features, at least one of the plurality of adjustable drilling bit features including a plurality of selectable virtual versions having a different size, shape, or quantity selectable within a continuum of values; and performing a multi-objective optimization between the set of drilling application performance requirements and each of the plurality of adjustable virtual drilling bit features to thereby determine feature attributes of the of drilling bit features that when combined to form a candidate virtual drilling bit provide the candidate virtual drilling bit with drilling bit performance characteristics substantially coinciding, with the determined drilling application performance requirements to thereby provide a virtual design for an optimal drilling bit defining a candidate optimal drilling bit for drilling the target hole section.

4. A method as defined in claim 3, further comprising the steps of:

determining drilling bit performance characteristics of the candidate optimal drilling bit;

generating a multidimensional map comprising a drilling application performance requirements map of the drilling application performance requirements overlaid with a drilling bit performance characteristics map of the drilling bit performance characteristics of the candidate optimal drilling bit to thereby provide a multidimensional visual comparison between the drilling application performance requirements and drilling bit performance characteristics for the candidate optimal drilling bit.

5. A method as defined in claim 1, wherein the formation properties include at least three of the following: porosity, density, compressional sonic wave velocity, shear sonic wave velocity, unconfined compressed strength, borehole pressure strengthening Mohr's friction angle, grain size, and mineralogy;

wherein the drillability parameters include at least three of the following: unconfined compressed strength, confined compressed strength, abrasiveness, bit balling tendency, bottom balling tendency, and vibration tendency;

wherein the set of combined drillability parameters is a single set of combined drillability parameters; and wherein the target hole section performance requirements include at least three of the following: mechanical efficiency, axial aggressiveness, lateral aggressiveness, lateral stability, torsional stability, cooling efficiency, cleaning efficiency, erosion resistance, abrasion resistance and impact resistance.

6. A method as defined in claim 1, wherein the step of combining each of the plurality of sets of drillability parameters includes one of the following methodologies:

simple summation of the drillability parameter values of each set of drillability parameters across each of the plurality of sets of drillability parameters;

summation of corresponding weighted drillability parameter values of each set of drillability parameters across each of the plurality of sets of drillability parameters, the drillability parameter values weighted based on thickness of the respective formation;

determining an arithmetic mean of corresponding drillability parameter values of each set of drillability parameters across each of the plurality of sets of drillability parameters; and determining a geometric mean of corresponding drillability parameter values of each set of drillability parameters across each of the plurality of sets of drillability parameters.

7. A method as defined in claim 1, wherein the step of combining the set of target hole section performance requirements and the set of drilling system performance characteristics includes one of the following methodologies:

performing a simple summation of the drilling system performance attribute values of the set of drilling system performance characteristics and the corresponding target hole section performance attribute values of the set of target hole section performance requirements;

performing a weighted summation of the drilling system performance attribute values of the set of drilling system performance characteristics with the corresponding target hole section performance attribute values of the set of target hole section performance requirements;

determining an arithmetic mean of corresponding drilling system performance attribute values of the set of drilling system performance characteristics with the corresponding target hole section performance attribute values of the set of target hole section performance requirements;

determining a geometric mean of corresponding drilling system performance attribute values of the set of drilling system performance characteristics with the corresponding target hole section performance attribute values of the set of target hole section performance requirements; and determining scaled values of each of the target hole section performance attribute values, the drilling system performance attribute values applied as scale factors to the target hole section performance attribute values.

8. A method as defined in claim 2, wherein the step of performing a multi-objective optimization between the set of drilling application performance requirements and each set of drilling bit performance characteristics includes the step, of determining a scalar product of the drilling application performance attribute values of the set of drilling application performance requirements and the performance attribute values of each set of drilling bit performance characteristics for each separate one of the plurality of sets of drilling bit performance characteristics.

9. A method as defined in claim 2, further comprising the steps of generating a correlation coefficient indicating the correlation of each of the plurality of drillability parameters with one or more of the plurality of formation properties to thereby enhance selection of one or more formation properties to be used to determine each drillability parameter for each separate one of the'plurality of formations;

generating a multidimensional performance attribute map of the target hole section performance requirements responsive to the step of determining the target hole section performance requirements;

generating a multidimensional performance characteristics map of the drilling system performance characteristics responsive to the step of determining the drilling system performance characteristics;

generating a multidimensional performance requirements map of the drilling application performance requirements responsive to the step of combining the set of target hole section performance requirements and the set of drilling-system performance characteristics; and generating a performance characteristics map of the drilling bit performance characteristics for each separate one of the plurality of candidate drilling bits to thereby define a plurality of drilling bit performance characteristics maps.

10. A computer-assisted method of selecting and optimizing a drilling bit for drilling an identified target hole section of earth, the method comprising the steps of:

determining a performance attribute value for each of a plurality of performance attributes describing performance requirements of the target hole section for drilling the target hole section responsive to a set of drillability parameters to define a set of target hole section performance requirements to thereby define a set of drilling application performance requirements;

receiving at least one virtual drilling bit model having a plurality of adjustable virtual drilling bit features responsive to a virtual library including the plurality of adjustable virtual drilling bit features, at least one of the plurality of adjustable drilling bit features including a plurality of selectable virtual versions having a different size, shape, or quantity selectable within a continuum of values;

performing a multi-objective optimization between the set of drilling application performance requirements and each of the plurality of adjustable virtual drilling bit features;

responsive to the step of performing a multi-objective optimization, determining the feature attributes of the plurality of drilling bit features that when combined to form a candidate virtual drilling bit provide the candidate virtual drilling, bit with drilling bit performance characteristics substantially coinciding, with the determined drilling application performance requirements, the candidate virtual drilling bit providing a virtual drilling bit design for an optimal drilling bit defining a candidate optimal drilling bit for drilling the target hole section;

determining drilling bit performance characteristics of the candidate optimal drilling bit; and generating a multidimensional map comprising a drilling application performance requirements map of the drilling application performance requirements overlaid with a performance characteristics map of the drilling bit performance characteristics for the candidate optimal drilling bit to thereby provide a multidimensional visual comparison between the drilling application performance requirements and drilling bit performance characteristics for the candidate optimal drilling bit.

11. Drilling bit selection and optimization program product stored in a tangible computer medium to select an existing drilling bit or optimize a drilling bit design to have performance characteristics substantially matching drilling application performance requirements for an identified target hole section of earth, the program product including instructions that when executed by a computer, cause the computer to perform the operations of:

determining a performance attribute value for each of a plurality of performance attributes describing target hole section performance requirements of the target hole section for drilling the target hole section responsive to a set of drillability parameters to define a set of target hole section performance requirements to thereby define a set of drilling application performance requirements;

determining a performance attribute value of each of a plurality of performance attributes describing drilling bit performance characteristics associated with a preselected drilling bit for each of a plurality of candidate drilling bits responsive to a plurality of drilling bit features to thereby define a plurality of sets of drilling bit performance characteristics;

performing a multi-objective optimization between the set of drilling application performance requirements and each set of drilling bit performance characteristics;

responsive to the operation of performing a multi-objective optimization, identifying one or more of the plurality of candidate drilling bits having a substantial alignment between the set of drilling application performance requirements and the respective set of drilling bit performance characteristics to thereby select a best match drilling bit for drilling the target hole section;

providing data to display a rank ordered list of candidate drilling bits responsive to performing the multi-objective optimization; and generating a multidimensional map comprising a drilling application performance requirements map of the drilling application performance requirements overlaid with at least one of a plurality of drilling bit performance characteristics maps of the drilling bit performance characteristics to thereby provide a multidimensional visual comparison between the drilling application performance requirements and drilling bit performance characteristics for at least one of the plurality of candidate drilling bits.

12. Drilling bit selection and optimization program product stored in a tangible computer medium to select an existing drilling bit or optimize a drilling bit design to have performance characteristics substantially matching drilling application performance requirements for an identified target hole section of earth, the program product including instructions that when executed by a computer, cause the computer to perform the operations of:

determining a performance attribute value for each of a plurality of performance attributes describing performance requirements of the target hole section for drilling the target hole section responsive to a set of drillability parameters to define a set of target hole section performance requirements to thereby define a set of drilling application performance requirements;

receiving at least one virtual drilling bit model having a plurality of adjustable virtual drilling bit features responsive to a virtual library including the plurality of adjustable virtual drilling bit features, at least one of the plurality of adjustable drilling bit features including a plurality of selectable virtual versions having a different size, shape, or quantity selectable within a continuum of values;

performing a multi-objective optimization between the set of drilling application performance requirements and each of the plurality of adjustable virtual drilling bit features;

responsive to the operation of performing a multi-objective optimization, determining feature attributes of the plurality of drilling bit features that when combined to form a candidate virtual drilling bit provide the candidate virtual drilling bit with drilling bit performance characteristics substantially coinciding with the determined drilling application performance requirements, the candidate virtual drilling bit providing a virtual drilling bit design for an optimal drilling bit defining a candidate optimal drilling bit for drilling the target hole section.

determining drilling bit performance characteristics of the candidate optimal drilling bit; and generating a multidimensional map comprising a drilling application performance requirements map of the drilling application performance requirements overlaid with a performance characteristics map of the drilling bit performance characteristics for the candidate optimal drilling bit to thereby provide a multidimensional visual comparison between the drilling application performance requirements and drilling bit performance characteristics for the candidate optimal drilling bit.

* * * * *